US006951380B2

(12) United States Patent
Kubota et al.

(10) Patent No.: US 6,951,380 B2
(45) Date of Patent: Oct. 4, 2005

(54) METHOD OF MANUFACTURING MICROSTRUCTURE, METHOD OF MANUFACTURING LIQUID DISCHARGE HEAD, AND LIQUID DISCHARGE HEAD

(75) Inventors: Masahiko Kubota, Tokyo (JP); Wataru Hiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 10/615,305

(22) Filed: Jul. 9, 2003

(65) Prior Publication Data

US 2004/0070643 A1 Apr. 15, 2004

(30) Foreign Application Priority Data

Jul. 10, 2002 (JP) ..... 2002-201805

(51) Int. Cl.[7] ..... B41J 2/015; G03C 5/00

(52) U.S. Cl. ..... 347/20; 347/47; 430/320; 430/326

(58) Field of Search ..... 347/20, 47, 45, 347/46, 63; 430/320, 15, 326; 216/27; 427/555

(56) References Cited

U.S. PATENT DOCUMENTS

| | | | | |
|---|---|---|---|---|
| 4,565,859 | A | 1/1986 | Murai et al. | 528/365 |
| 4,657,631 | A | 4/1987 | Noguchi | 156/656 |
| 4,882,595 | A | 11/1989 | Trueba et al. | 346/140 R |
| 5,331,344 | A | 7/1994 | Miyagawa et al. | 347/63 |
| 5,478,606 | A | 12/1995 | Ohkuma et al. | 427/555 |
| 5,730,889 | A | 3/1998 | Miyagawa et al. | 216/27 |
| 5,945,260 | A | 8/1999 | Miyagawa et al. | 430/320 |
| 6,158,843 | A | 12/2000 | Murthy et al. | 347/47 |
| 6,179,413 | B1 | 1/2001 | Coulman et al. | 347/63 |
| 2003/0011655 | A1 * | 1/2003 | Miyagawa et al. | 347/20 |

FOREIGN PATENT DOCUMENTS

| | | | |
|---|---|---|---|
| EP | 734866 A2 * | 10/1996 | B41J/2/16 |
| EP | 0734866 B1 | 8/1999 | |
| JP | 60-161973 | 8/1985 | |
| JP | 63-221121 | 9/1988 | |
| JP | 64-9216 | 1/1989 | |
| JP | 2-140219 | 5/1990 | |
| JP | 4-216952 | 8/1992 | |
| JP | 6-45242 | 6/1994 | |
| JP | 10-291317 | 11/1998 | |
| JP | 2000/326515 | 11/2000 | |
| JP | 3143307 | 12/2000 | |

OTHER PUBLICATIONS

Journal of Polymer Science "Fourth International Symposium on Cationic Polymerization", pp 383–395, (1976).

* cited by examiner

*Primary Examiner*—Manish S. Shah
(74) *Attorney, Agent, or Firm*—Fitzpatrick, Cella, Harper & Scinto

(57) ABSTRACT

A liquid discharge head which is inexpensive, accurate, and highly reliable, and a method of manufacturing such a liquid discharge head are provided. On a substrate, a thermal crosslinking positive photosensitive material layer (a first positive photosensitive material layer) and a second positive photosensitive material layer are formed. First a pattern is formed on the second positive photosensitive material layer, then another pattern is formed on the first positive photosensitive material layer. Next, a negative resin for forming a liquid channel wall is laminated on the patterned first and second positive photosensitive material layers. A discharge port is formed in the negative resin layer and then the positive photosensitive material layers are removed. At this time, the first positive photosensitive material layer is an ionizing radiation decompositive positive resist composed of a methacrylic copolymer composite mainly containing methacrylic acid where a metacrylic acid unit is 2 to 30 wt % and molecular weight is 5,000 to 50,000, and the second positive photosensitive material layer is an ionizing radiation decompositive positive resist mainly containing polymethyl isopropenyl ketone.

14 Claims, 16 Drawing Sheets

METHOD OF MANUFACTURING MICROSTRUCTURE, METHOD OF MANUFACTURING LIQUID DISCHARGE HEAD, AND LIQUID DISCHARGE HEAD

BACKGROUND OF THE INVENTION

1. Field of the Invention

The present invention relates to a method of manufacturing a liquid discharge head for generating droplets of a recording liquid used in an ink-jet recording system and a liquid discharge head obtained by this method. More particularly, the present invention relates to a shape of an ink channel which provides stable discharge of minute droplets for enabling high image quality and achieves high speed recording, and to a method of manufacturing a head.

Furthermore, the present invention relates to an ink-jet head whose ink discharge property is improved in accordance with the method of manufacturing the ink-jet head.

2. Description of the Related Art

A liquid discharge head applied to an ink-jet recording method (liquid discharge recording method) in which recording is performed by discharging a recording liquid such as ink is generally provided with liquid channels, liquid discharge energy generating parts which are arranged in a part of each liquid channel, and fine recording liquid discharge ports (hereinafter referred to as "orifices") for discharging the liquid in the liquid channel by thermal energy of the liquid discharge energy generating parts. As conventional methods of manufacturing such a liquid discharge recording head as the above, there have been known a manufacturing method including steps of forming through holes for ink supply on an element substrate having thereon heaters generating thermal energy for discharging a liquid, driver circuits driving these heaters, or the like, followed by performing patterning to form walls of an ink channel using a photosensitive negative resist, and subsequently joining the patterned substrate to a plate on which is formed ink discharge ports by electroforming or excimer laser machining (e.g., U.S. Pat. No. 6,179,413, or the like), and also a manufacturing method including steps of preparing an element substrate formed in the same manner as in the above method, and machining a resin film (polyimide is preferably used in general) coated with an adhesive layer to form an ink channel and ink discharge ports by excimer laser, and subsequently joining the machined liquid channel structure plate to the element substrate through thermo-compression bonding (e.g., U.S. Pat. No. 6,158,843, or the like).

In the ink-jet head manufactured according to these methods, a distance between the heater and the discharge port which exerts an influence on an discharge amount must be as short as possible in order to enable the discharge of minute droplets for achieving high image quality recording. Therefore, there is a need to lower a height of the ink channel, or to reduce the size of a discharge chamber which is a part of the ink channel and is a bubble production chamber adjacent to the liquid discharge energy generating part, or also to reduce the size of the discharge port. That is, in order to enable the discharge of minute droplets by the head manufactured according to those methods, it is required to make the liquid channel structure laminated on a substrate thinner. However, there is extreme difficulty in precisely machining such a thin liquid channel structure plate and joining thereto a substrate.

In order to solve problems residing in those methods, Japanese Patent Publication No. 6-45242 discloses a method of manufacturing an ink-jet head, including steps of patterning a mold of an ink channel using a photosensitive material on a substrate on which is formed liquid discharge energy generating elements, coating a coating resin layer on the substrate so as to cover the mold pattern, forming ink discharge ports to be communicated with the mold of the ink channel on the coating resin layer, thereafter removing the photosensitive material used to form the mold (hereinafter abbreviated as "casting"). As the photosensitive material used in this method of manufacturing the head, a positive type resist is used in terms of removability. According to this method, application of a photolithography technique in a semiconductor process allows highly precise and fine machining in forming discharge ports and the like. This method adopting such a method of manufacturing semiconductors, however, basically limits variations of a shape in the vicinity of the ink channel and discharge ports to those only in a two-dimensional direction parallel to an element substrate. This means that the use of the photosensitive material for the mold of the ink channel and discharge ports is made impossible to form a partially multilayered photosensitive material layer, so that a desired pattern having differences in a height direction of the mold of the ink channel and the like may not be obtained (the shape in a height direction from the element substrate is uniformly restricted). This may result in a problem when designing ink channels for attaining high speed, stable discharge.

Japanese Patent Application Laid-Open No. 10-291317 discloses that, in excimer laser machining for a liquid channel structure, by partially changing opacity of a laser mask and controlling a machining depth in a resin film, variations in shape of an ink channel are realized in a three-dimensional direction which includes an in-plane direction parallel to an element substrate and a height direction from the element substrate. The depth direction can thus basically be controlled by laser machining, however, the excimer laser used in these machining is different from that used in an exposing process of semiconductors and requires a high luminance laser over a wide range, therefore it is extremely difficult to suppress dispersion in illuminance within a laser irradiated surface and to realize stable laser illuminance. Particularly in an ink-jet head offering a high quality image, non-uniform discharge properties due to variations in a machining shape among respective discharge nozzles are recognized as unevenness in a printed image, it is therefore highly required to realize the enhancement of machining accuracy.

Moreover, there is often the case that minute patterns cannot be formed due to tapers on a laser machining surface.

In Japanese Patent Application Laid-Open No. 4-216952, disclosed is a method of forming a first layer of negative resist on a substrate and thereafter forming a latent image of a desired pattern, coating a second layer of negative resist on the first layer and thereafter forming a latent image of a desired pattern only on the second layer, and in the end developing pattern latent images for each upper and lower layer, wherein these two layers of upper and lower negative resists have mutually different photosensitive wavelength ranges such that both upper and lower negative resists are sensitive to ultraviolet (UV), or that the negative upper resist is sensitive to ultraviolet (UV) and the negative lower resist is sensitive to an ionizing radiation including Deep UV, electron rays, X rays, or the like. According to this method, by using two layers of upper and lower negative resists having mutually different photosensitive wavelength ranges, pattern latent images can be formed, which have a difference in those shapes not only in a direction parallel to a substrate and also in a height direction from the substrate.

The inventor et al. of the present invention have earnestly studied to apply the technique disclosed in Japanese Patent Application Laid-Open No. 4-216952 to the above described casting. That is, it has been expected that the application of the technique disclosed therein to the formation of a mold for ink channels according to casting allows local changes in a height of a positive resist used as the mold of ink channels and the like.

An attempt has actually been made such that, as a photoresist removable by dissolving and sensitive to ultraviolet (UV) as described in Japanese Patent Application Laid-Open No. 4-216952, an alkaline developing positive photoresist composed of a mixture of an alkali-soluble resin (novolak resin or polyvinylphenol) and a naphthoquinone diazide derivative is used, and as a photoresist sensitive to an ionizing radiation, polymethyl isopropenyl ketone (PMIPK) is used, so as to form a mold having upper and lower patterns mutually different relative to a substrate. However, the alkaline developing positive photoresist is immediately dissolved in a developing solution for PMIPK, so that different patterns for two layers fail to be formed.

Therefore, another attempt has been made to discover a preferable combination of upper and lower layers of positive photosensitive materials capable of forming a mold pattern having a difference of shapes in a height direction relative to a substrate according to casting.

The present invention is designed in consideration of the above-mentioned various problems and an object thereof is to provide a liquid discharge head which is inexpensive, precise, and highly reliable, and a method of manufacturing the liquid discharge head.

The present invention relates more particularly to an ink channel shape which allows refilling of ink while rapidly suppressing meniscus oscillation by suitably adjusting a three-dimensional shape of an ink channel, and a method of manufacturing a liquid discharge head provided therewith.

Another object of the present invention is to provide a novel method of manufacturing a liquid discharge head, capable of producing a liquid discharge head having a structure in which a liquid channel is formed precisely and accurately, and machined finely in excellent yield.

Still another object of the present invention is to provide a novel method of manufacturing a liquid discharge head, capable of producing a liquid discharge head with less mutual effect to a recording liquid which is excellent in mechanical strength as well as in chemical tolerance.

SUMMERY OF THE INVENTION

The present invention is characterized in that a manufacturing method by which a liquid channel of a three-dimensional shape is highly accurately formed is realized, and that an excellent liquid channel shape realized by such a method is discovered.

The first invention proposes a method of manufacturing a microstructure which includes a step of forming a thermally crosslinked positive photosensitive material layer (first positive photosensitive material layer) on a substrate, a step of forming on the first positive photosensitive material layer a second positive photosensitive material layer different from the first positive photosensitive material layer in a photosensitive wavelength range, a step of firstly forming a pattern on the second positive photosensitive material layer by decomposing and then developing only a desired area in the second positive photosensitive material layer, and a step of secondly forming a pattern different from that formed on the second positive photosensitive material layer on the first positive photosensitive material layer by decomposing and then developing a predetermined area in the first positive photosensitive material layer, the method which is characterized in that the first positive photosensitive material layer is an ionizing radiation decompositive positive resist composed of a methacrylic copolymer composite mainly containing a methacrylate and also containing methacrylic acid as a thermal crosslinking factor where a methacrylic acid unit is 2 to 30 wt % and copolymer molecular weight is 5,000 to 50,000, and the second positive photosensitive material layer is an ionizing radiation decompositive positive resist which mainly contains polymethyl isopropenyl ketone.

The second invention provides a method of manufacturing a liquid discharge head which includes a step of forming a mold pattern by a removable resin in a liquid channel forming portion on a substrate on which is formed a liquid discharge energy generating element, and a step of coating and then curing a coating resin layer on the substrate so as to coat the mold pattern to form a liquid channel by dissolving away the mold pattern, the method which is characterized in that the step of forming the mold pattern successively comprises a step of forming on the substrate a positive photosensitive material layer (first positive photosensitive material layer) thermally crosslinked by means of a thermal crosslinking reaction, a step of forming on the first positive photosensitive material layer a second positive photosensitive material layer different from the first positive photosensitive in a photosensitive wavelength range, a step of forming a desired pattern on the second positive photosensitive material layer by decomposing and then developing only a desired pattern on the second positive photosensitive material layer by means of an ionizing radiation for exposing the second positive photosensitive material layer onto the substrate on which two layers of the positive photosensitive material layers are formed, and a step of forming another desired pattern on the first positive photosensitive material layer by decomposing and then developing a predetermined area on the first positive photosensitive material layer by means of an ionizing radiation for exposing the first positive photosensitive material layer onto the substrate on which the desired pattern is formed on the second positive photosensitive material layer, and that the first positive photosensitive material layer is an ionizing radiation decompositive positive resist composed of a methacrylic copolymer composite mainly containing a methacrylate and also containing methacrylic acid as a thermal crosslinking factor where a methacrylic acid unit is 2 to 30 wt % and copolymer molecular weight is 5,000 to 50,000, and that the second positive photosensitive material layer is an ionizing radiation decompositive positive resist which mainly contains polymethyl isopropenyl ketone.

In the first and second inventions, it is preferable that the lower layer of the positive photosensitive material layer is the ionizing radiation decompositive positive resist mainly containing a methacrylate and is two-element copolymer material including methacrylic acid as a thermal crosslinking factor, and the upper layer of the positive photosensitive material layer is the ionizing radiation decompositive positive resist mainly containing polymethyl isopropenyl ketone.

Furthermore, the present invention includes a liquid discharge head manufactured by the method of manufacturing the liquid discharge head as described above.

Moreover, the liquid discharge head manufactured according to the method of the present invention as described above is preferably constituted so that a columnar member for trapping dust is formed of a material composing the liquid channel in the middle of the liquid channel, and more preferably, the columnar member does not reach the substrate. Furthermore, the liquid discharge head manufactured according to the method of the present invention as described above is preferably constituted so that a liquid supply port commonly connected to each of the liquid channels are formed in the substrate, and that a height of the liquid channel in a center portion of the liquid supply port is lower than that of the liquid channel in an opening edge portion of the liquid supply port.

Also the liquid discharge head manufactured according to the method of the present invention as described above is preferably constituted so that a sectional shape of a bubble generating chamber provided above a liquid discharge energy generating element has a protruded form.

DETAILED DESCRIPTION OF THE PREFERRED EMBODIMENT

Figure 1A:
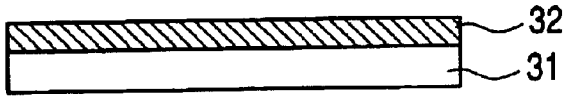
FIGS. 1A, 1B, 1C, 1D, 1E, 1F, and 1G are diagrams showing a basic process flow in a manufacturing method according to the present invention.

The present invention will be described in further detail below.

A manufacturing process of a liquid discharge head according to the present invention has advantages such that one of important factors exerting an influence on an liquid discharge head property, which is a distance between a discharge energy generating element (for example, a heater) and an orifice (discharge port), and position accuracy of the element and the center of the orifice, may easily be set. That is, according to the present invention, by controlling coating thickness of a photosensitive material layer to be coated twice, the distance between the discharge energy generating element and the orifice may be set, and the coating thickness of the photosensitive material layer may strictly controlled in excellent reproducibility by a thin film coating technique conventionally applied. Also, positioning of the discharge energy generating element and the orifice may be performed optically by a photolithography technique, which thus provides highly accurate positioning as compared with a conventional method of joining a substrate to a liquid channel structure plate used to manufacture a liquid discharge recording head.

As a soluble resist layer, polymethyl isopropenyl ketone (PMIPK), polyvinyl ketone, or the like is known. Each of these positive resists has an absorbing ability that reaches a peak near the wavelength of 290 nm, and by combining these resists with another resist having a different photosensitive wavelength range, an ink channel mold of two layer-structure may be formed.

The manufacturing method of the present invention is characterized by forming a mold of the ink channel using a soluble resin, coating the mold with a resin which serves as a channel member, and then removing the mold material by dissolving it in the end. Therefore, the mold material applicable in this manufacturing method must be removable by dissolving in the end. A soluble resist used to form a pattern and to be dissolved after patterning includes two types of resists which are alkaline developing positive photoresist composed of a mixture of alkali-soluble resin (novolak resin or polyvinyl phenol) and a naphthoquinone diazide derivative, and an ionizing radiation decompositive resist, both of which are widely applied in a semiconductor photolithography process. A general photosensitive wavelength of the alkaline developing positive photoresist ranges from 400 nm to 450 nm which is different from that of the polymethyl isopropenyl ketone (PMIPK), however, the alkaline developing positive photoresist cannot actually be applied to form patterns of two layers because it is immediately dissolved in a developing solution of the PMIPK.

On the other hand, a high-polymer compound composed of a methacrylate (methacrylate ester) such as polymethyl methacrylate (PMMA) or the like which is one of ionizing radiation decompositive resists is a positive resist having absorption ability that reaches a peak in a photosensitive wavelength range of 220 nm or below, and by making it into a methacrylic copolymer composite including methacrylic acid as thermal crosslinked factors, non-exposed portion of thermally crosslinked film is hardly dissolved in a PMIPK developing solution, therefore this ionizing radiation decompositive resist may be applied to form patterns of two layers. Accordingly, on this resist (P (MMA-MAA)), the resist layer (PMIPK) composed of the foregoing PMIPK is formed, and firstly the upper layer of PMIPK is exposed at a second wavelength range in the vicinity of 290 nm (260 nm to 330 nm) and is then developed, next the lower layer of PMMA is exposed to the ionizing radiation at a first wavelength range (210 nm to 330 nm) and is then developed, whereby two layers of an ink channel mold pattern may be formed.

A thermal crosslinking resist most preferable in the present invention is a methacrylate obtained by copolymerizing methacrylic acid as a crosslinking group. The methacrylate may include methyl methacrylate, butyl methacrylate, phenyl methacrylate, or the like.

A copolymarization ratio of crosslinking components is preferably made suitable depending on a thickness of the lower layer resist, and a copolymerized amount of methacrylic acid as a thermal crosslinking factor is desirably 2 to 30 wt %, and more preferably 2 to 10 wt %. In addition, molecular weight of a methacrylic copolymer of a methacrylate and methacrylic acid is desirably 5,000 to 50,000. When the molecular weight becomes larger, the solubility in a solvent on solvent coating application becomes lower, and even when the dissolving is satisfactory completed, a viscosity of the solvent itself exceedingly increases, thereby lowering the uniformity of thickness in a coating process by spin coating.

Furthermore, large molecular weight reduces dissolving efficiency to the ionizing radiation in a wavelength region from 210 nm to 330 nm which is the first wavelength range, and therefore requires large amount of exposure to form a desired pattern with a desired thickness and degrades developing performance relative to a developing solution, resulting in lowering accuracy of a pattern to be formed. On the other hand, extremely small molecular weight makes solubility in a solvent too high, and therefore considerably reduces viscosity of the solution, resulting in failing to form a desired thickness by spin coating. Accordingly, the desirable molecular weight of the two-element, copolymer of the methacrylate and methacrylic acid is 5,000 to 30,000.

Note here that a methacrylic copolymer is made by dissolving the methacrylate and methacrylic acid in a polymerization catalyst such as toluene or xylene, and then heating it at temperature within a range from ambient temperature to a boiling point of a usual polymerization catalyst in the presence of azo-based polymerization catalyst or a peroxide polymerization catalyst. The methacrylic copolymer used in the present invention has a nature of being crosslinked when heated, therefore it is preferable to polymerize at 60° C. to 80° C.

In the following, a process flow of forming an ink channel according to the manufacturing method of the present invention will be described.

FIGS. 1A, 1B, 1C, 1D, 1E, 1F, and 1G show the most preferable process flow of when a thermal crosslinking positive resist is applied to a lower layer resist. FIGS. 2A and 2B show a continuation of the process in FIG. 1.

Figure 2A:
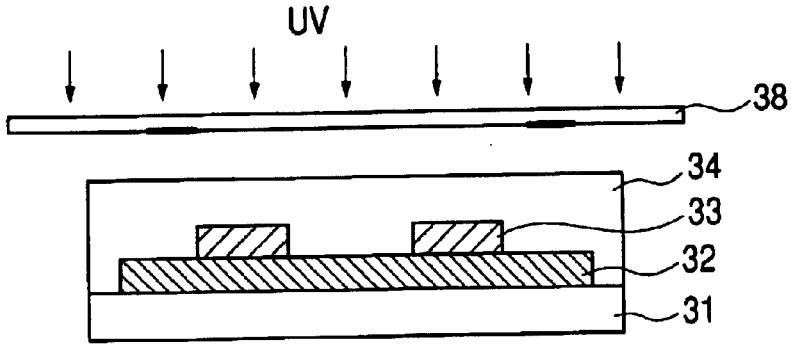
FIGS. 2A, 2B, 2C, and 2D are diagrams showing a continuation of the process in FIGS. 1A, 1B, 1C, 1D, 1E, 1F, and 1G.
Figure 2B:
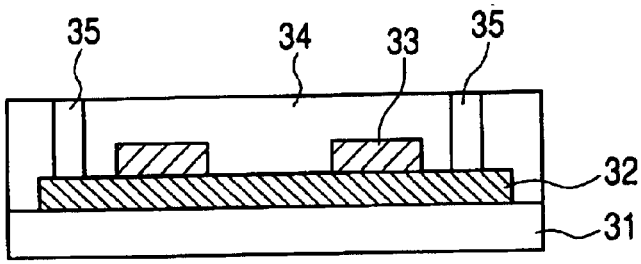

As shown in FIG. 1A, a thermal crosslinking positive resist layer 32 is coated on a substrate 31 and is then baked, where general-purpose solvent coating such as spin coating or bar coating may be applied in coating. Also, baking temperature is performed preferably at 160° C. to 220° C. where a thermal crosslinking reaction occurs, for 30 minutes to 2 hours.

Figure 1B:
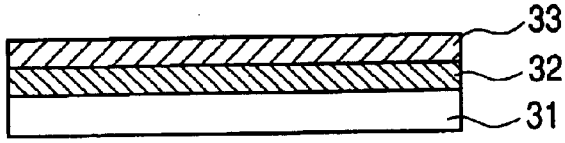

Next, as shown in FIG. 1B, a positive resist layer 33 mainly containing PMIPK is coated on the thermal crosslinking positive resist and is then baked. Generally, a coating solvent coated upon the coating of the upper layer of PMIPK helps the lower layer to be slightly dissolved, and a compatible layer is thereby formed, however, the thermal crosslinking resist is employed in this constitution so that the compatible layer is not formed at all.

Figure 1C:
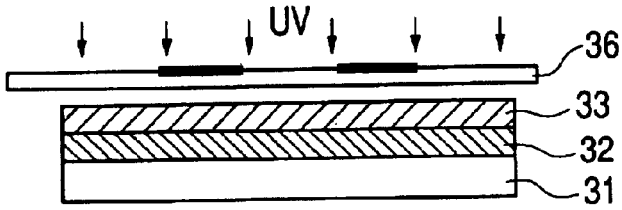
Figure 4:
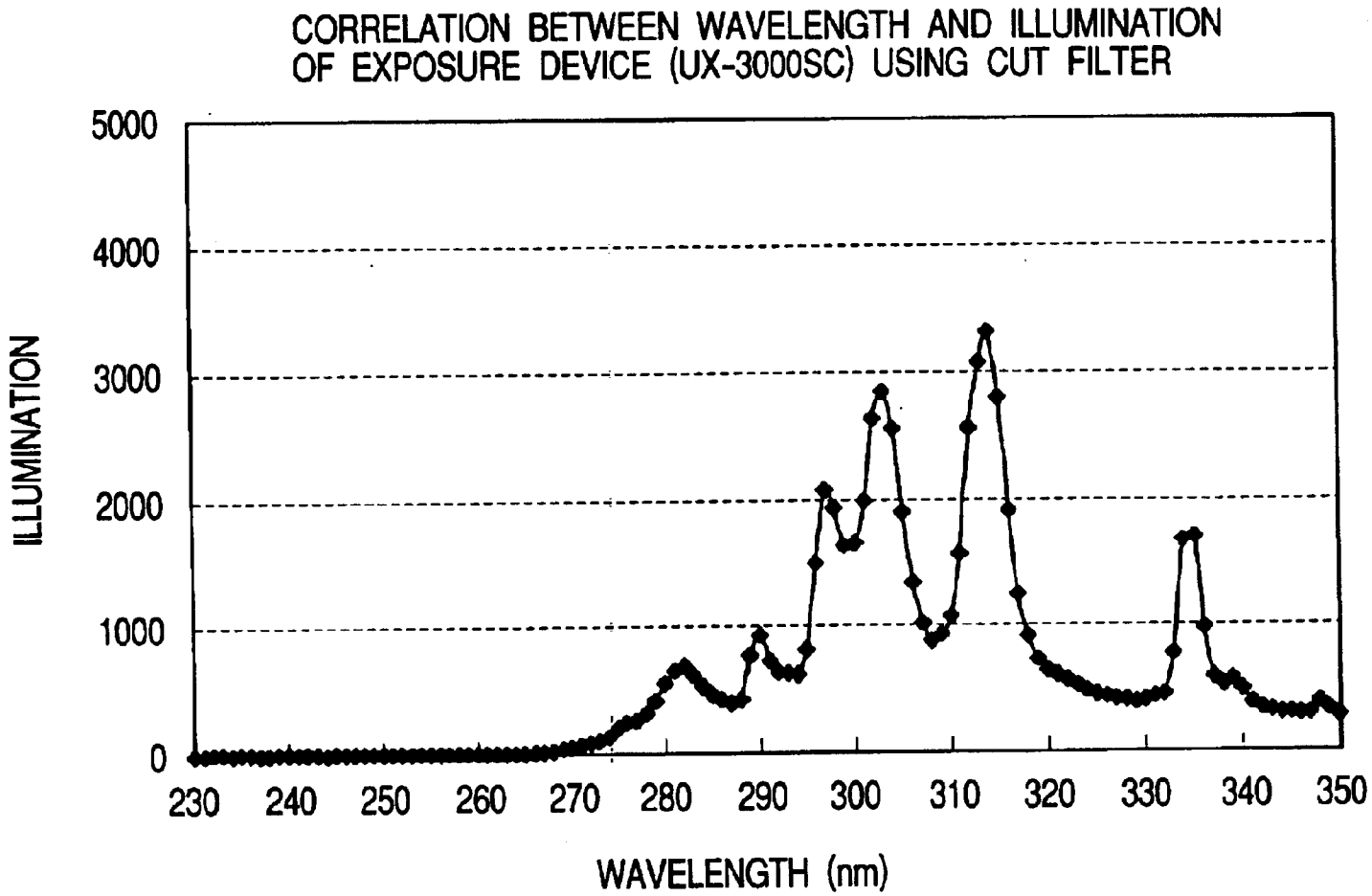
FIG. 4 is a diagram showing correlation between wavelength and illumination of exposure device (UX-3000SC) using a cutoff filter.

Next, as shown in FIG. 1C, the PMIPK layer which is the positive resist layer 33 is exposed where it is preferable to use a cold mirror that satisfactorily reflects light at wavelengths in the vicinity of 290 nm. For example, a Mask Aligner UX-3000SC of USHIO INC. is applied wherein a cutoff filter for cutting off light of wavelengths of 260 nm or shorter is provided at a tip of an integrator including a net type lens, which allows transmission of only light of wavelengths from 260 nm to 330 nm which is the second wavelength range as shown in FIG. 4.

Figure 1D:
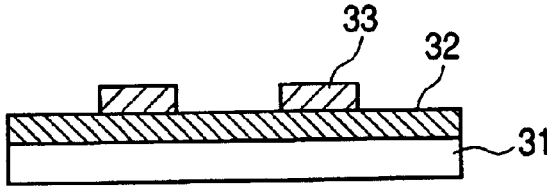

Next, as shown in FIG. 1D, the upper resist layer 33 is developed where it is preferable to use methyl isobutyl ketone which is a developing solution for the PMIPK, however, any solvent is applicable if it does dissolve exposed portions of the PMIPK but not dissolve non-exposed portions.

Figure 1E:
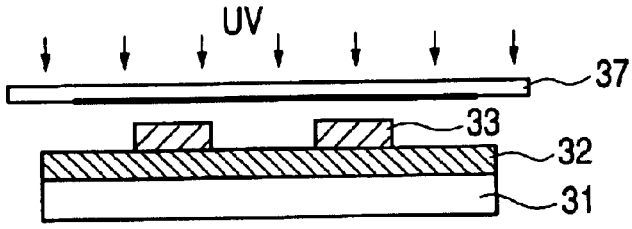
Figure 5:
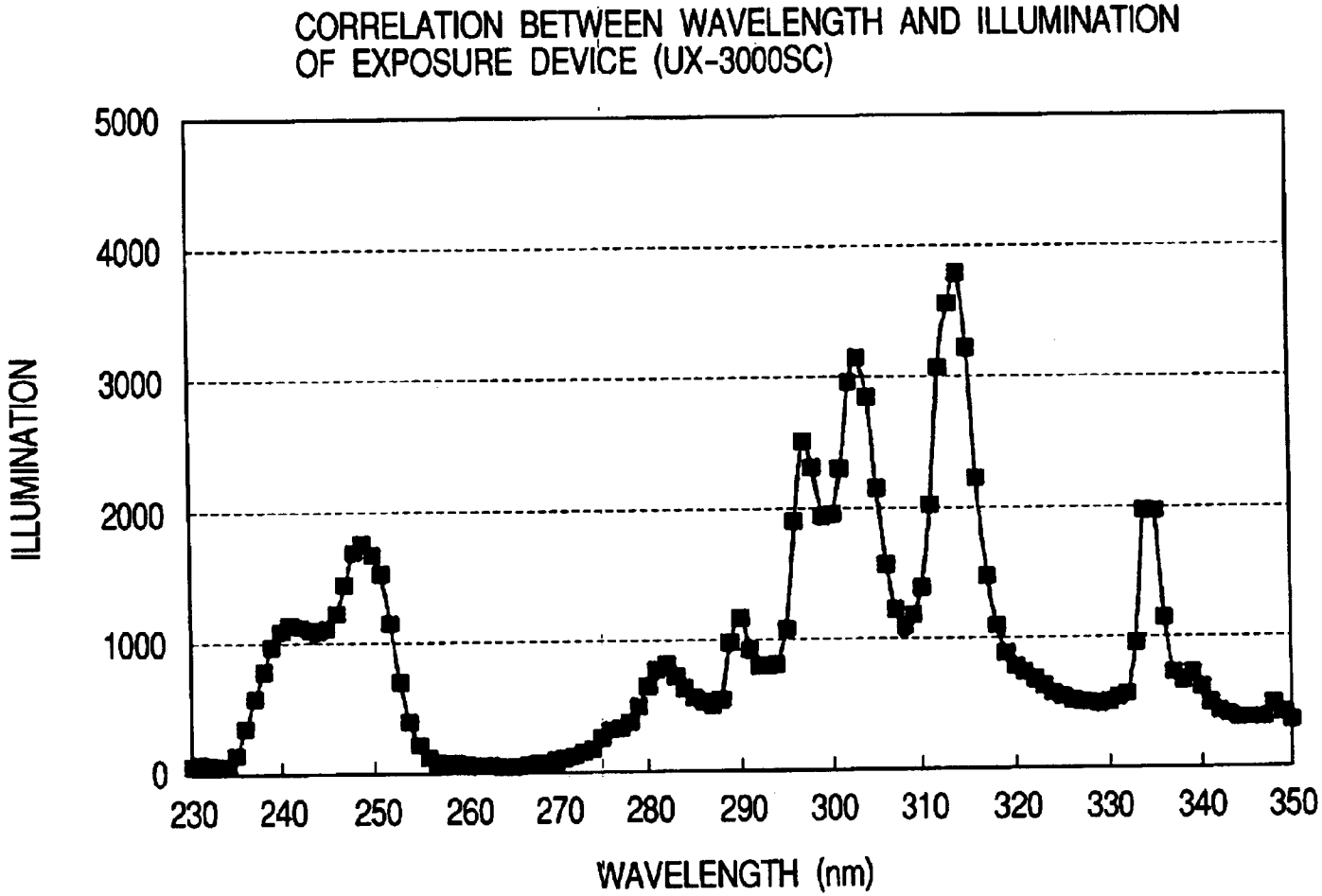
FIG. 5 is a diagram showing correlation between wavelength and illumination of exposure device (UX-3000SC) without the cutoff filter.

Next, as shown in FIG. 1E, the lower layer of thermal crosslinking positive resist layer 32 is exposed to light at wavelengths from 210 nm to 330 nm which is the first wavelength range shown in FIG. 5 without using the cutoff filter. At this time, the upper layer of PMIPK is not irradiated with light because of a photomask 37, and is therefore not sensitized.

Figure 1F:
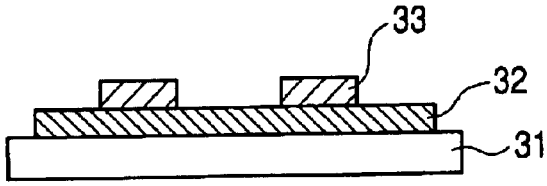

Next, as shown in FIG. 1F, the thermal crosslinking positive resist layer 32 is developed where it is preferable to use methyl isobutyl ketone which is the same as the developing solution used for the upper layer PMIPK, eliminating an affect of the developing solution to the upper layer pattern.

Figure 1G:
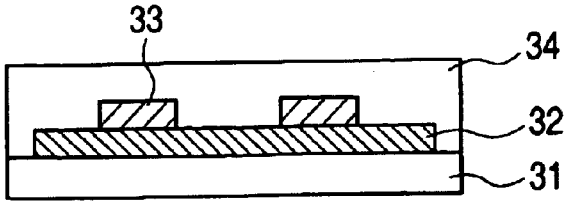

Next, as shown in FIG. 1G, a liquid channel structure material 34 is coated so as to cover the lower layer of thermal crosslinking positive resist layer 32 and the upper layer of positive resist layer 33 where general-purpose solvent coating such as spin coating may be applied.

The liquid channel structure material used herein is preferably a material mainly containing an onium salt which is an epoxy resin in a solid state at a normal temperature and which produces cation when irradiated with light. The liquid channel structure material has a negative property. The details are described in Japanese Patent No. 3143307.

More specifically, a cationically polymerized cured epoxy resin offers excellent properties as a structure material because it has higher crosslinking density (high Tg) compared with a cured product of acid anhydride or amine in a normal state. Also, the use of the solid epoxy resin at normal temperature leads to the suppression of diffusion of polymerization initiator sources into the epoxy resin which are produced from a cationic polymerization initiator by light irradiation, which allows to obtain excellent patterning accuracy and shape.

Examples of the solid epoxy resin for use in the present invention include reaction products of bisphenol A and epichlorohydrin which have molecular weight equal to or greater than 900, reaction products of bromine-containing bisphenol A and epichlorohydrin, reaction products of phenolic novolak or o-cresol novolak and epichlorohydrin, and polyfunctional epoxy resins having oxycyclohexane skeleton described in the specifications of Japanese Patent Application Laid-Open Nos. 60-161973, 63-221121, 64-9216, and 2-140219. Needless to say, the epoxy resin in the present invention is not restricted to these compounds.

The epoxy resin used herein is preferably that with an epoxy equivalent of 2,000 or less, and more preferably 1,000 or less. An epoxy equivalent in excess of 2,000 may lead to a decrease in the crosslinking density during the curing reaction, thereby lowering the Tg or heat distortion temperature of the cured product, or deteriorating the adhesion or ink resistance.

Examples of a cationic photo-polymerization initiator for curing the epoxy resin include aromatic iodonium salts, aromatic sulfonium salts [see J. POLYMER SCI: Symposium No. 56 383–395 (1976)], SP-150 and SP-170 marketed by Asahi Denka Co., Ltd., or the like.

To the above-described composite, additives or the like may be suitably added as needed. For example, a flexibility-imparting agent is added for the purpose of lowing the elastic modulus of the epoxy resin, or a silane coupling agent is added for the purpose of further enhancing the adherence to the substrate.

FIG. 2A shows a process of light irradiation onto the liquid channel structure material, in which a photomask 38 is applied to prevent the light irradiation to portions where ink discharge ports are formed.

Next, as shown in FIG. 2B, pattern development of ink discharge ports 35 is performed to the photosensitive liquid channel structure material 34. In this pattern exposing, any general-purpose exposure device may be applicable. The development of the photosensitive liquid channel structure material is performed using preferably an aromatic solvent such as xylene which does not dissolve PMIPK.

Also, the coating of a water repellent coating film on the liquid channel structure material layer if desired to be coated is attained, as described in Japanese Patent Application Laid-Open 2000-326515, by forming a photosensitive water repellent layer, and exposing and developing it simultaneously. At this time, the photosensitive water repellent layer may be formed by laminating.

Figure 2C:
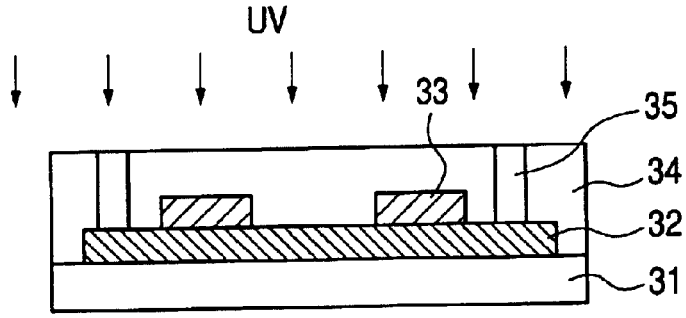

Next, as shown in FIG. 2C, the ionizing radiation of 300 nm wavelength or less is irradiated through the liquid channel structure material layer. This aims to decompose the PMIPK or crosslinking resist into low molecular weight compounds in order to enable easy removal.

Figure 2D:
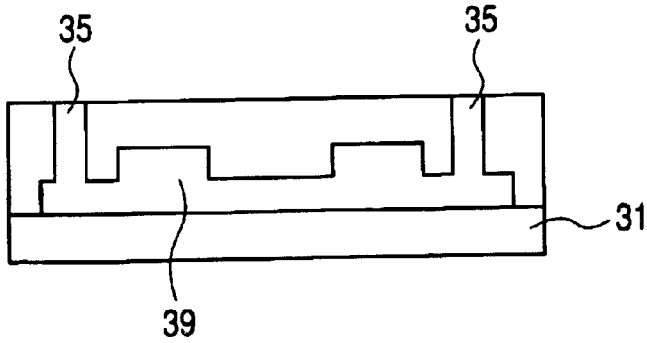
Figure 3:
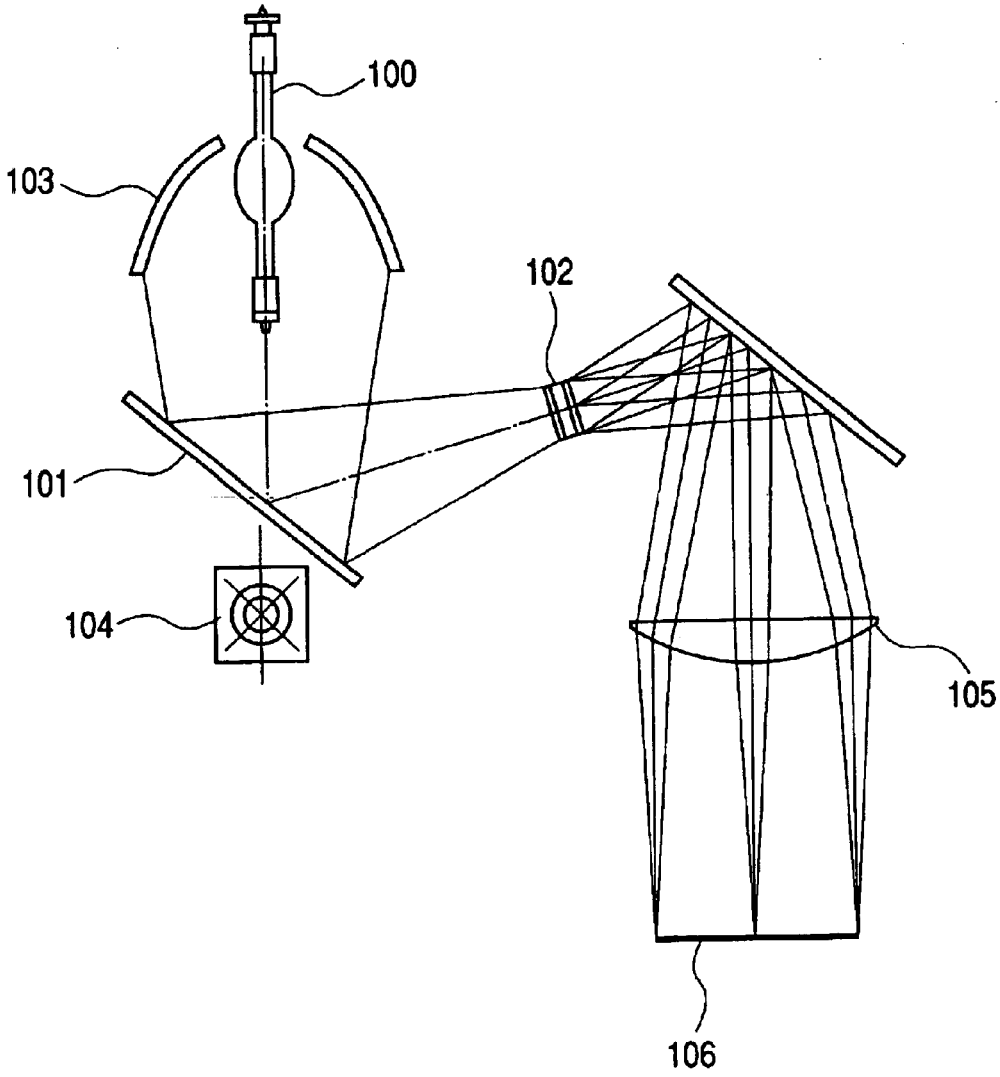
FIG. 3 is a schematic diagram of an optical system of a general-purpose exposure device and is a diagram showing reflecting spectrums of two types of cold mirrors.

In the end, the positive resists 32 and 33 used as the mold are removed using a solvent. Consequently, a liquid channel 39 including a discharge chamber is formed as shown in FIG. 2D.

By applying the above described processes, it is possible to impart variations in a height of the ink channel from an ink supply port to heater.

Such a process as described above allows the height of the ink channel from the ink supply port to the heater to be varied. The optimization of the shape of the ink channel from the ink supply port to the discharge chamber not only has strong relation with the speed of refilling ink into the discharge chamber and also allows the reduction in cross-talk between the discharge chambers. The specification of U.S. Pat. No. 4,882,595 of Trueba et al. discloses the relation between the shape of the ink channel formed with a photosensitive resist on a substrate in a two-dimensional direction parallel to the substrate, and the above property. On the other hand, Japanese Patent Application Laid-Open No. 10-291317 of Murthy et al. discloses a process of machining a liquid channel structure plate made of resin by excimer laser in a three-dimensional direction including an in-plane direction and a height direction relative to a substrate in order to vary the height of the ink channel.

The excimer laser machining, however, often cannot realize sufficient accuracy due to film expansion and the like caused by heat that is generated in machining. Particularly, the machining accuracy of the excimer laser in a depth direction of a resin film is affected by illuminance distribution or stability of laser light, therefore the accuracy sufficient to define the correlation between the ink channel shape and the discharge property cannot be assured. Accordingly, Japanese Patent, Application Laid-Open No. 10-291317 does not have any description of definite correlation between the height of the ink channel and the discharge property.

The manufacturing method according to the present invention is conducted by solvent coating such as spin coating or the like employed in a semiconductor manufacturing technology, whereby the height of the ink channel may be formed stably in high accuracy. Furthermore, a shape in a two-dimensional direction parallel to a substrate may be formed with submicron accuracy by using a photolithography technique which is for a semiconductor process.

By applying these methods, the inventor et al. of the present invention have studied the correlation between the height of the ink channel and the discharge property and have reached the following invention. Referring to FIGS. 6A to 9B, preferred embodiments of a liquid discharge head to which the manufacturing method of the present invention is applied will be described below.

Figure 6A:
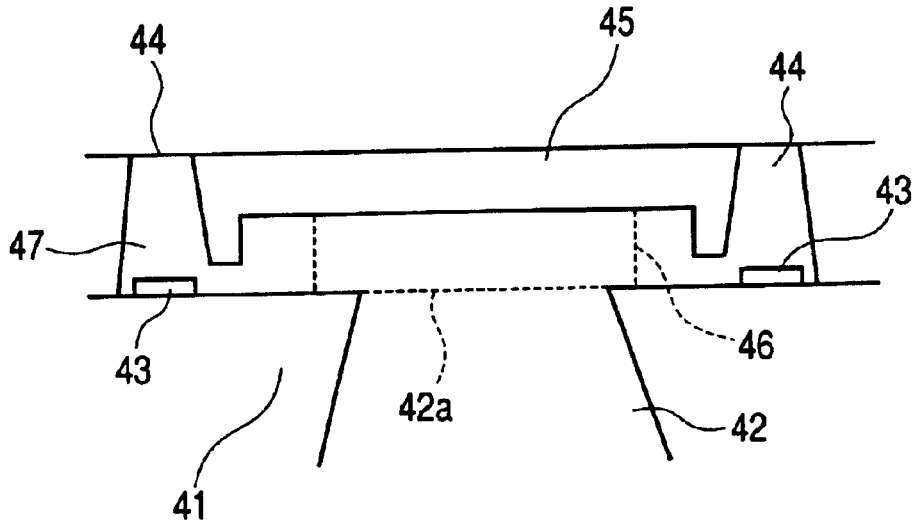
FIGS. 6A and 6B are a longitudinal sectional view showing a structure of a nozzle in an ink-jet head whose recording speed is improved according to the manufacturing method of the present invention, and a longitudinal sectional view showing a structure of a nozzle in an ink-jet head manufactured according to a conventional manufacturing method, respectively.

A liquid discharge head in a first embodiment of the present invention is, as shown in FIG. 6A, is characterized in that a height of an ink-channel from an end part 42 of an ink supply port 42 up to a discharge chamber 47 is lowered in a portion adjacent to the discharge chamber 47.

Figure 6B:
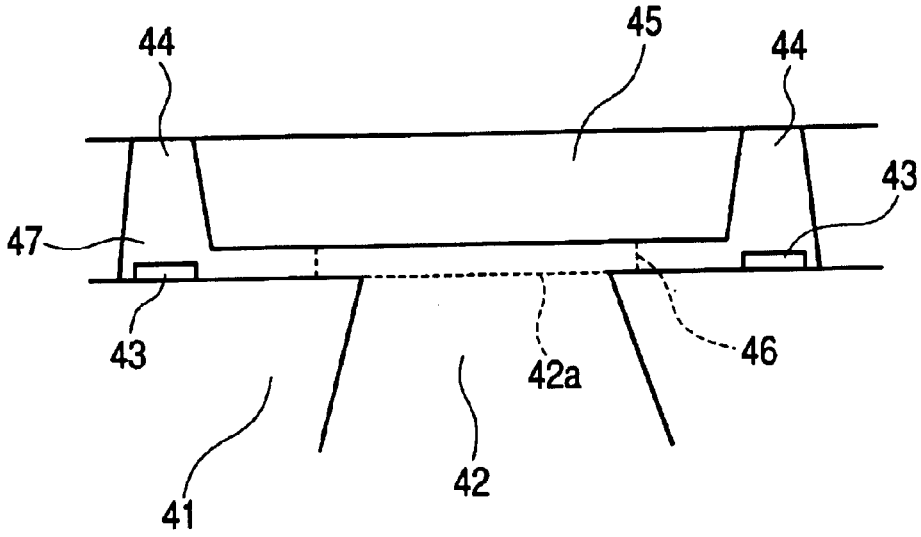

FIG. 6B shows a shape of an ink channel for comparison with the first embodiment. The speed of refilling ink into the discharge chamber 47 is accelerated because ink flow resistance can be reduced with increasing height of the ink channel from the ink supply port 42 to the discharge chamber 47. However, when the channel is made higher, discharge pressure escapes to the ink supply port 42 side, which decreases energy efficiency and causes excessive crosstalk between discharge chambers 47.

Therefore, the height of the discharge chamber is designed in consideration of the above two properties, whereupon the manufacturing method of the present invention is applied, allowing the height of the ink channel to be varied. The ink channel shape shown in FIG. 6A may thus be realized.

The head is so constituted as to reduce the ink flow resistance to thereby enable rapid refilling of ink by having the ink channel made higher from the ink supply port 42 to the vicinity of the discharge chamber 47. Furthermore, the head is so constituted as to suppress the escape of energy generated in the discharge chamber 47 to the ink supply port 42 side to thereby prevent cross-talk by having the ink channel made lower in the vicinity of the discharge chamber 47.

Next, a liquid discharge head in a second embodiment of the present invention is, as shown in FIG. 7, is characterized in that a columnar dust trapping member (hereinafter referred to as a "nozzle filter") is provided in the middle of the ink channel.

Figure 7A:
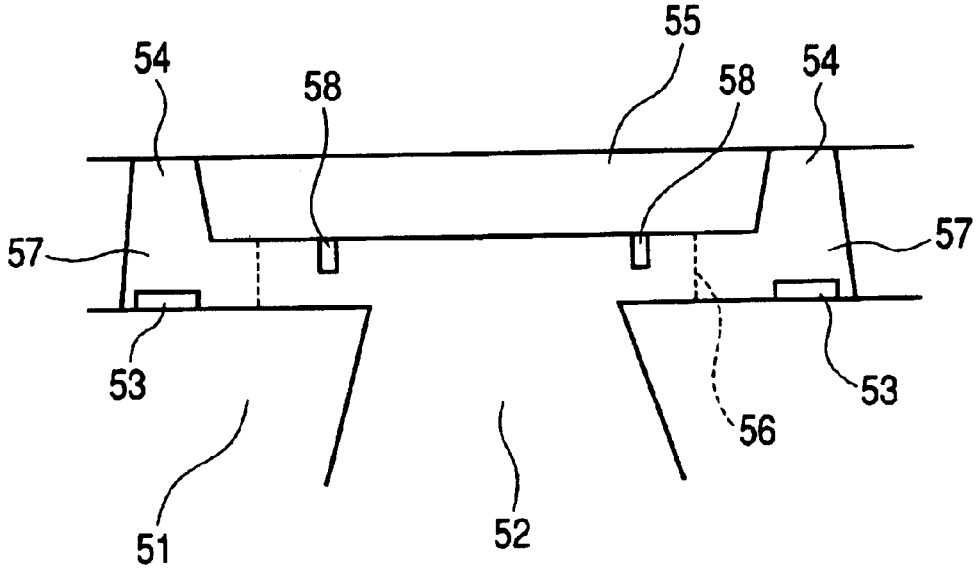
FIGS. 7A and 7B are a longitudinal sectional view of an ink-jet head having an improved shape of a nozzle filter according to the manufacturing method of the present invention, and a longitudinal sectional view of an ink-jet head having a conventional shape of a nozzle filter, respectively.
Figure 7B:
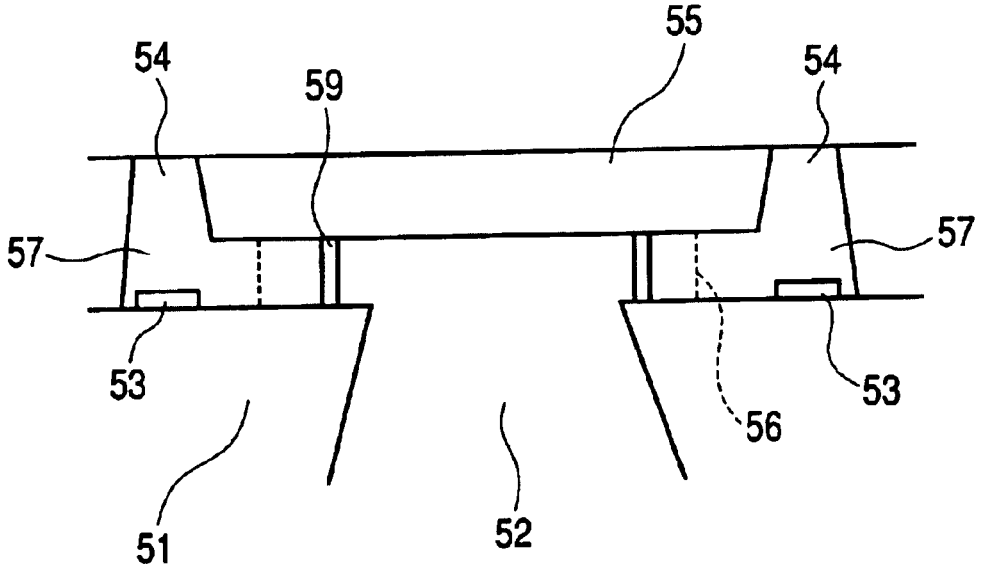

Particularly in FIG. 7A, nozzle filters 58 are formed so as not to reach a substrate 51. FIG. 7B shows nozzle filters 59 which are in contact with the substrate 51. Such nozzle filters 58 and 59 cause an increase of ink flow resistance and deceleration of the refilling speed of ink into discharge chambers 57. However, ink discharge ports of an ink-jet head which realizes high quality image are extremely small, and if the above nozzle filters are not provided, the ink channel or discharge port is clogged with dust or the like, and reliability of the ink-jet head may considerably be impaired.

According to the present invention, an ink channel area can be made maximum without changing a distance between adjacent nozzle filters from the conventional one, so that dusts may be trapped while suppressing an increase of the ink flow resistance. This means that, even the columnar nozzle filters are provided in the liquid channel, the height of the ink channel is varied while preventing an increase of in ink flow resistance.

For example, in order to trap pieces of dust of over 10 $\mu$m diameter, a distance between adjacent nozzle filters may be set to 10 $\mu$m or less. At this time, a column constituting the nozzle filter is preferably so designed as not to reach the substrate 51 as shown in FIG. 7A, to thereby enhance a sectional area of the channel.

Figure 8A:
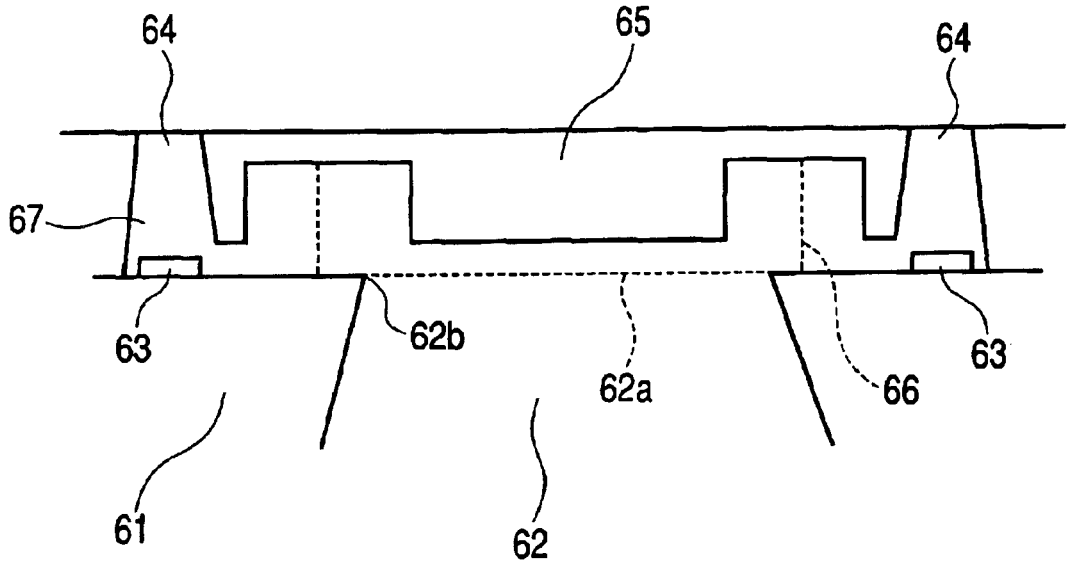
FIGS. 8A and 8B are a longitudinal sectional view showing a structure of a nozzle in an ink-jet head whose strength is enhanced according to the manufacturing method of the present invention, and a longitudinal sectional view showing a structure of a nozzle for comparison to a head shown above in FIG. 8A, respectively.
Figure 8B:
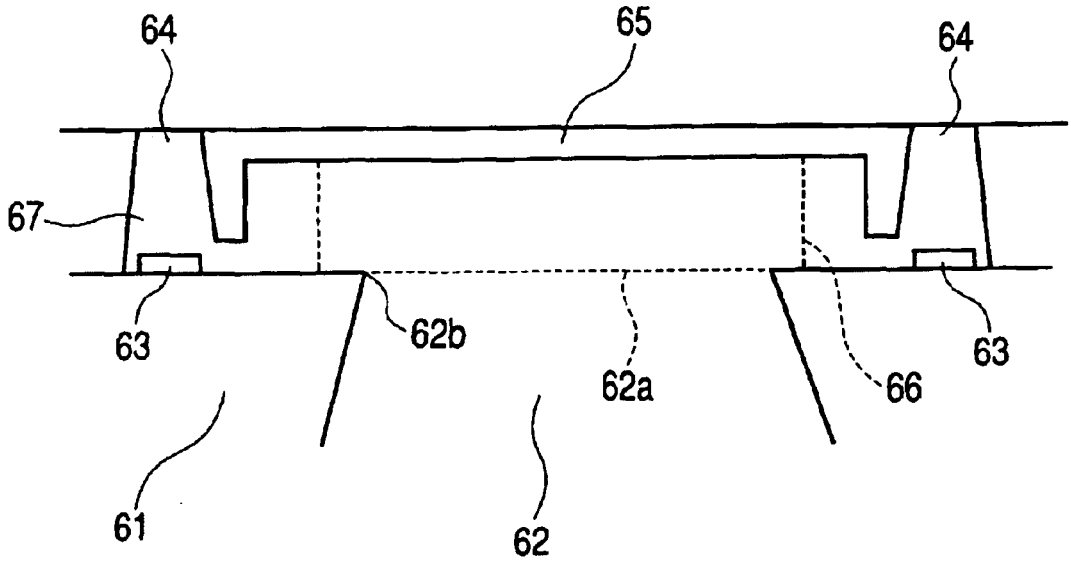

Next, a liquid discharge head in a third embodiment of the present invention is, as shown in FIG. 8A, is constituted so that the ink channel in a liquid channel structure material 65 that corresponds to the center of an ink supply port 62 is made lower than an ink channel portion corresponding to an opening edge part 62*b* of the ink supply port 62. FIG. 8B shows an ink channel shape for comparison with the third embodiment. In the head structure described referring to FIG. 6A, when the height of the ink channel from the end part 42*a* of the ink supply port 42 to the discharge chamber 47 is increased, the liquid channel structure material 65 corresponding to the ink supply port 62 is thinned as shown in FIG. 8B, which possibly impairs the reliability of the ink-jet head. For example, when paper jamming occurs during recording, it is conceivable that a membrane forming the liquid channel structure material 65 is torn thereby causing leakage of ink.

However, in the manufacturing method of the present invention, as shown in FIG. 8A, the liquid channel structure material 65 corresponding to the almost entire portion of the opening of the ink supply port 62 is made thick, and the channel height is raised in only a portion corresponding to the vicinity of the opening edge part 62*b* of the ink supply port 62 necessary for ink supply, thereby avoiding the above adverse effect. A distance from the ink supply port opening edge 62*b* in the portion where the channel height is raised by the liquid channel structure material 65 is determined depending on a discharge amount of a designed ink-jet head or ink viscosity, and is preferably 10 $\mu$m to 100 $\mu$m in general.

Figure 9A:
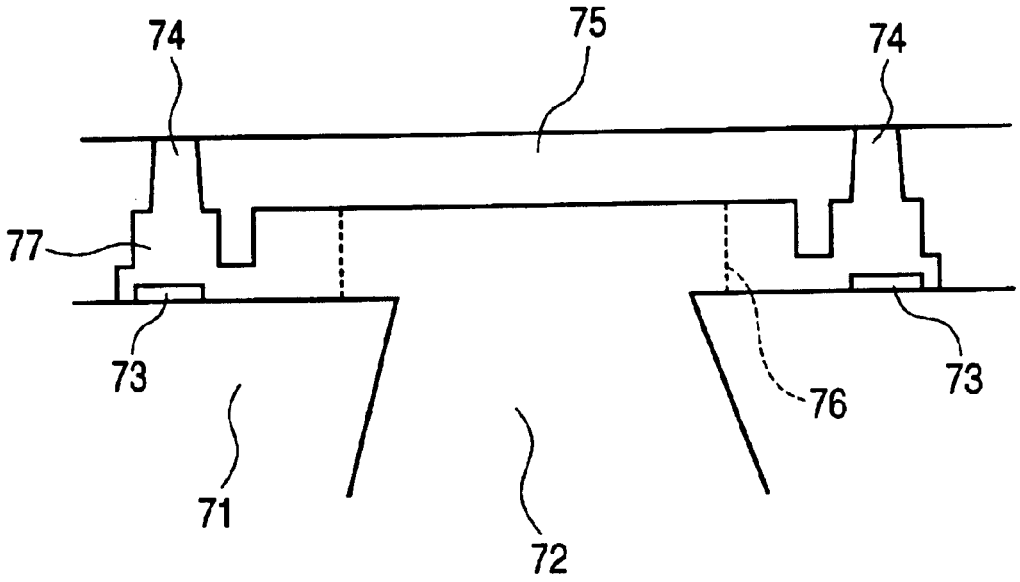
FIGS. 9A and 9B are a longitudinal sectional view showing a structure of a nozzle in an ink-jet head whose discharge chamber is improved according to the manufacturing method of the present invention, and a longitudinal sectional view showing a structure of a nozzle for comparison to a head shown above in FIG. 9A, respectively.
Figure 9B:
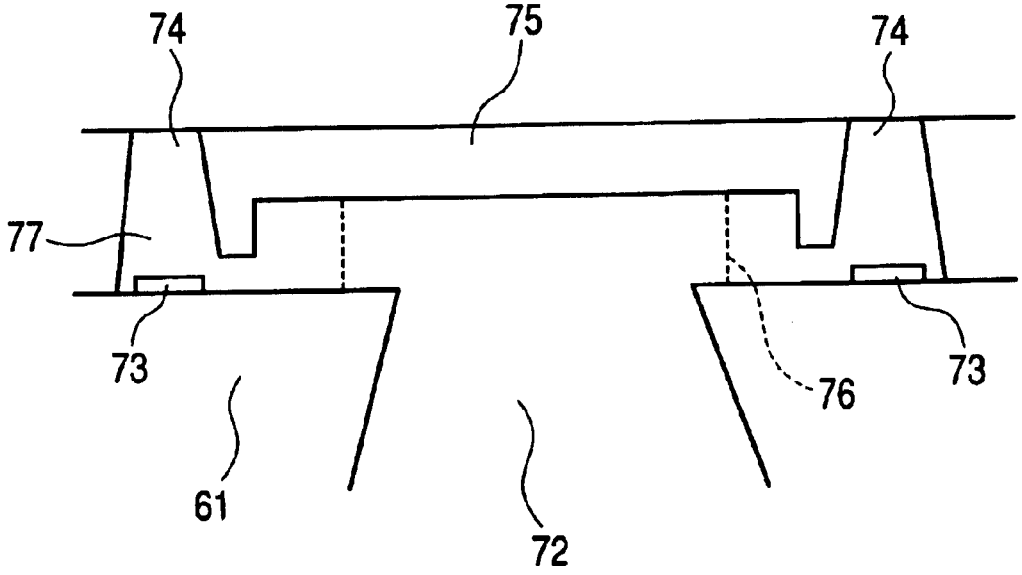

Next, a liquid discharge head in a fourth embodiment of the present invention is, as shown in FIG. 9A, characterized in that a discharge port shape of a discharge chamber 77 has a protruding sectional form. FIG. 9B is a discharge port shape of a discharge chamber for comparison with the fourth embodiment. The ink discharge energy changes depending on ink flow resistance defined by the shape of the discharge port in an upper part of a heater. In the conventional manufacturing method, the shape of the discharge port is formed by patterning of the liquid channel structure material, and thus has a form in which a discharge port pattern formed on a mask is projected. Therefore, the discharge port is formed through the liquid channel structure material with basically having the same area as a discharge port opening area on the liquid channel structure material surface.

However, in the manufacturing method of the present invention, by differentiating pattern shapes in the lower and upper layer materials, the discharge port of the discharge chamber 77 may be formed into a protrusion shape. This effectively accelerates the discharge speed and enhances a rectilinear advance property, leading to the provision of a recording head capable of high image quality recording.

Embodiments

The present invention will be described in detail below with reference to drawings.

(First Embodiment)

Each of FIGS. 10 to 19 shows a structure of a liquid jet recording head according to the present invention and an example of a manufacturing procedure of such a head. In this embodiment, the relation between upper and lower layers of a first positive photosensitive material layer and a second positive photosensitive material layer is schematically illustrated by these main portions and other specific structures are appropriately omitted.

In this embodiment, a liquid jet recording head having two orifices (discharge ports) is described, but the same is of course applicable to the case of a high density multi-array liquid jet recording head having more orifices than those mentioned herein.

Figure 10:
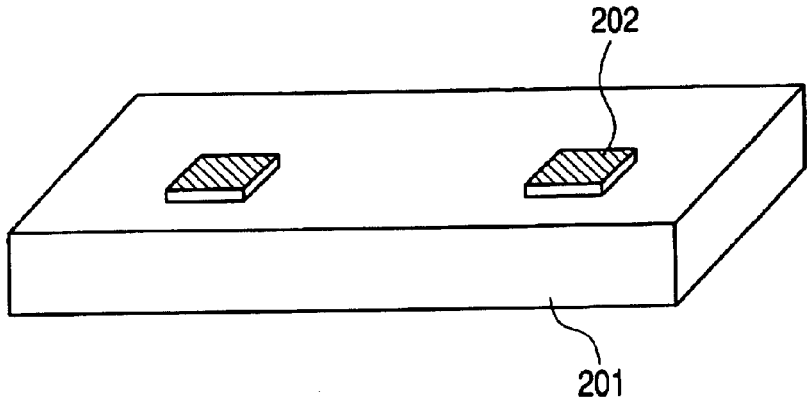
FIG. 10 is a schematic perspective view illustrating a manufacturing method according to one embodiment of the present invention.

In this embodiment, a substrate 201 made of a glass, ceramics, plastic, or metal is used as shown in FIG. 10, for example. FIG. 10 is a schematic perspective view of the substrate before forming the photosensitive material layer.

Such a substrate 201 serves as a part of a wall member of a liquid channel, and is usable without any particular limit to its shape, material, and the like as long as the substrate is functional as a supporting member of a liquid channel structure made of a photosensitive material layer which will be described later. On the above mentioned substrate 201, a desired number of liquid discharge energy generating elements 202 such as an electrothermal transducer or piezoelectric element are arranged (in FIG. 10, two are represented). By means of the liquid discharge energy generating elements 202, discharge energy is exerted to a recording liquid to discharge recording droplets for recording.

Here, for example, when the electrothermal transducers are used as the above described liquid discharge energy generating elements 202, the transducers heat the recording liquid in the vicinity thereof to generate the discharge energy. Also if, for example, the piezoelectric elements are used, these elements generate the discharge energy by the mechanical vibration thereof.

In this respect, electrodes (not shown) inputting control signals for driving these elements are connected to the elements 202. Also in general, for the purpose of improving the durability of these discharge energy generating elements 202, various functional layers are provided including a protective layer. It is allowed also in the present invention to provide such functional layers.

In most general cases, silicon is used for the substrate 201. That is, a driver, logic circuit, or the like for controlling discharge energy generating elements are produced in a general semiconductor manufacturing method, therefore it is preferable to apply silicon to the substrate. Furthermore, it is also possible to apply a technique such as YAG laser or sand blasting to a method for forming a through hole for ink supply on the silicon substrate.

However, when a thermal crosslinking resist is applied to the lower layer material, pre-baking temperature of this resist is extremely high as described above and far exceeds glass transition temperature of a resin. As a result, the resin coating film runs into the through hole during pre-baking. Therefore, it is preferable that the through hole is not yet formed on the substrate upon resist coating.

To a method therefor, an anisotropic etching technique for silicon using an alkaline solution may be applied. In this case, a mask pattern is formed on a rear face of the substrate by using alkali-resistant silicon nitride or the like, and a membrane film serving as an etching stopper is formed on a right face of the substrate using the same material.

Figure 11:
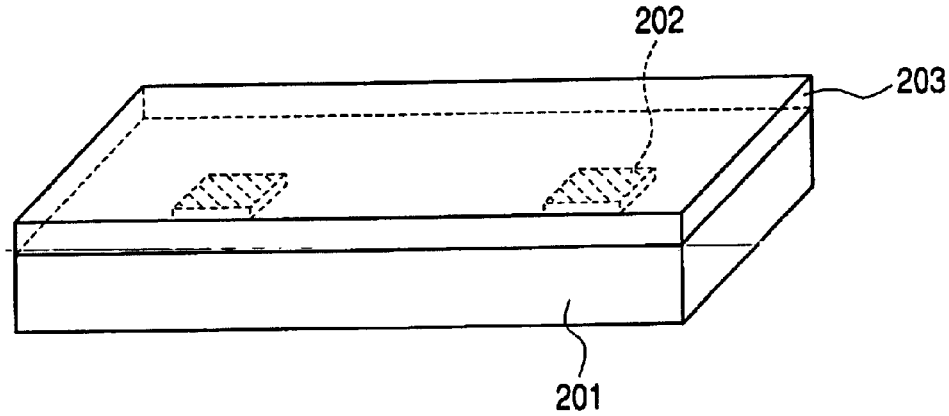
FIG. 11 is a schematic perspective view illustrating a process subsequent to the manufacturing state shown in FIG. 10.

Next, as shown in FIG. 11, a crosslinking positive resist layer 203 is formed on the substrate 201 including the liquid discharge energy generating elements 202. The material of the crosslinking positive resist layer 203 is a copolymer of methyl methacrylate and methacrylic acid (represented by P(MMA-MAA)) in a ratio of 90:10 where weight average molecular weight (Mw) is 33,000, number average molecular weight (Mn) is 14,000, and dispersity (Mw/Mn) is 2.36.

Figure 22A:
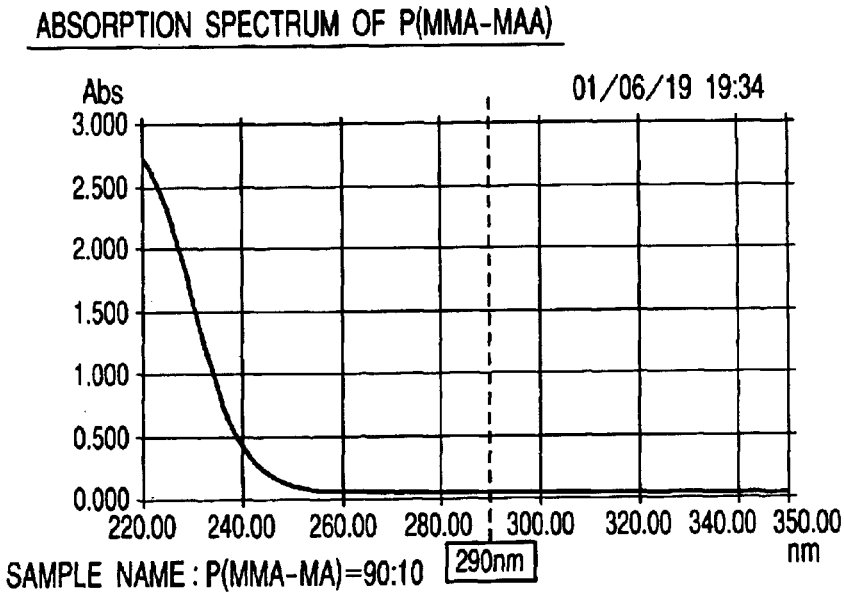
FIGS. 22A and 22B are diagrams showing absorption spectrums of a positive resist employed in the present invention.
Figure 22B:
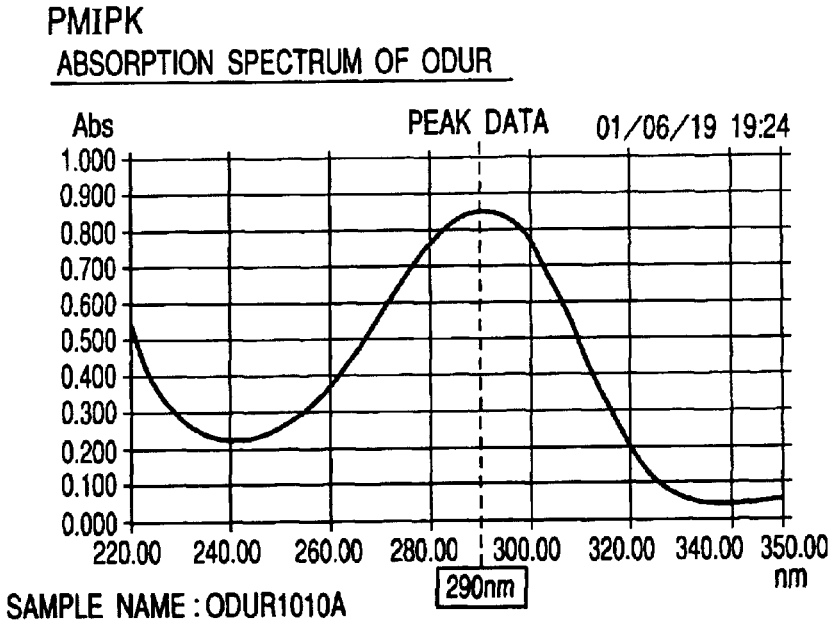

FIGS. 22A and 22B show herein a difference of absorption spectrums between P(MMA-MAA) which is the thermal crosslinking positive resist forming the lower layer and PMIPK which is the positive resist forming the upper layer. As shown in FIGS. 22A and 22B, by selectively changing a wavelength range upon exposure in accordance with the difference in the absorption spectrums between the materials forming the upper and lower layers, a mold resist pattern having a protrusion shape may be formed. Resin particles of the above material are dissolved in Cyclohexanone of 30 wt % density and the resultant is used as a resist liquid. The resist liquid is coated on the substrate 201 by spin coating, and is pre-baked at 200° C. for 60 minutes in an oven, then is made crosslinked. The thickness of a resultant coated film is 10 $\mu$m.

Figure 12:
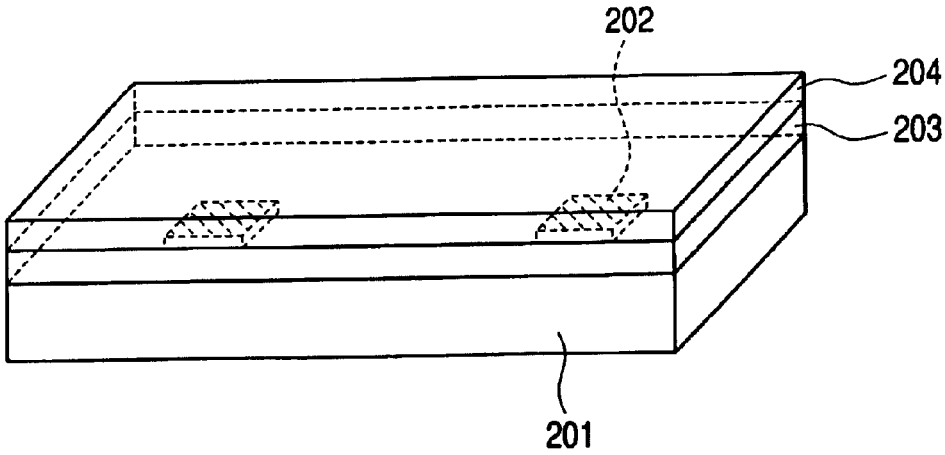
FIG. 12 is a schematic perspective view illustrating a process subsequent to the manufacturing state shown in FIG. 11.

Next, as shown in FIG. 12, a PMIPK positive resist layer 204 is coated on the thermal crosslinking positive resist layer 203. The PMIPK is used at resin density of 20 wt % which is adjusted by ODUR-1010 marketed by Tokyo Ohka Kogyo Co., Ltd. The pre-baking is performed on a hot plate at 120° C. for 6 minutes. The thickness of 10 $\mu$m of a resultant coated film is obtained.

Figure 13:
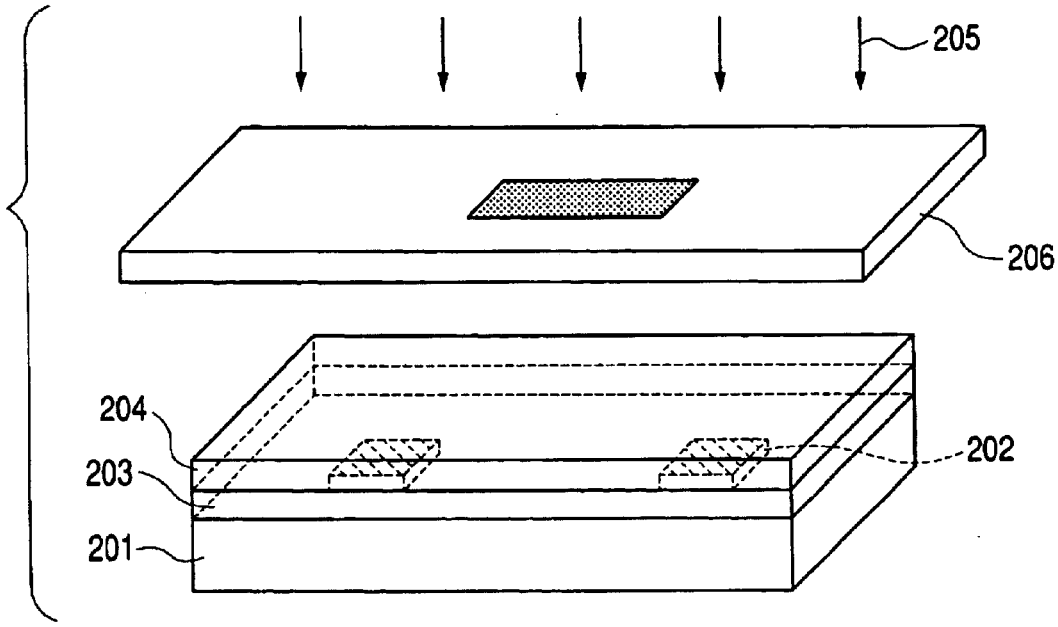
FIG. 13 is a schematic perspective view illustrating a process subsequent to the manufacturing state shown in FIG. 12.

Next, as shown in FIG. 13, the PMIPK positive resist layer 204 is exposed using as an exposure device, the Deep UV exposure device: UX-3000SC of Ushio Inc., by attaching thereto a cutoff filter for cutting off light at wavelength 260 nm or shorter, in a wavelength range of 60 nm to 330 nm which is the second wavelength range as shown in FIG. 4. An exposure amount is set to 10 J/cm$^2$. The PMIPK is irradiated with an ionizing radiation through a photo mask 205 on which a desired pattern is drawn.

Figure 14:
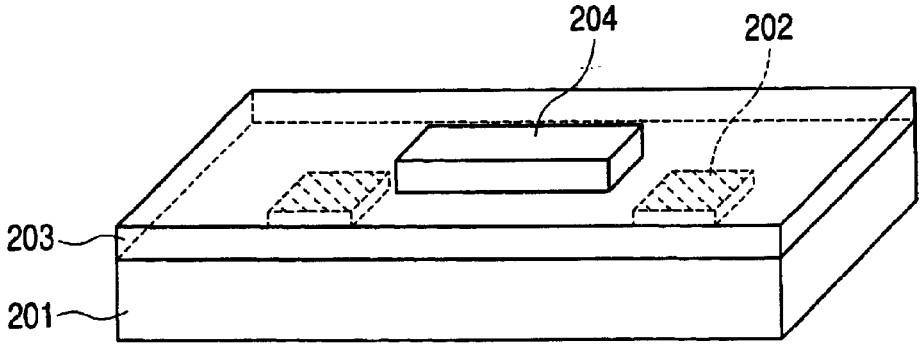
FIG. 14 is a schematic perspective view illustrating a process subsequent to the manufacturing state shown in FIG. 13.

Next, as shown in FIG. 14, the PMIPK positive resist layer 204 is developed for pattern forming by immersing it into methyl isobutyl ketone for 1 minute.

Figure 15:
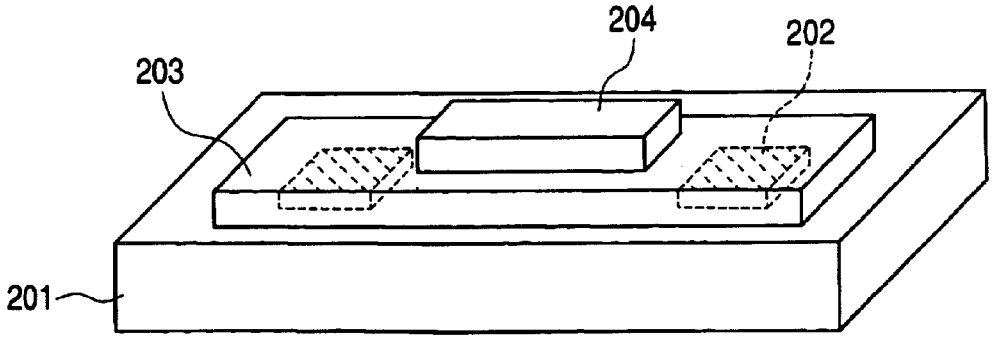
FIG. 15 is a schematic perspective view illustrating a process subsequent to the manufacturing state shown in FIG. 14.

Next, as shown in FIG. 15, the lower layer of the thermal crosslinking positive resist layer 203 is subjected to patterning (exposure and development). The same exposure device is used for exposing that is performed in a wavelength range of 210 nm to 330 nm which is the first wavelength range as shown in FIG. 5. An exposure amount is set to 35 J/cm$^2$, and methyl isobutyl ketone is used for developing. The exposing is conducted by irradiating an ionizing irradiation onto the thermal crosslinking positive resist through a photo mask (not shown) on which a desired pattern is drawn. At this time, the upper layer of the PMIPK pattern is reduced due to diffracted light from the mask, so that the PMIPK remaining portion is designed in consideration of such reduction. Of course, when an exposure device provided with a projection optical system which is not affected by such diffracted light is used, there is no need to design the mask taking the reduction into consideration.

Figure 16:
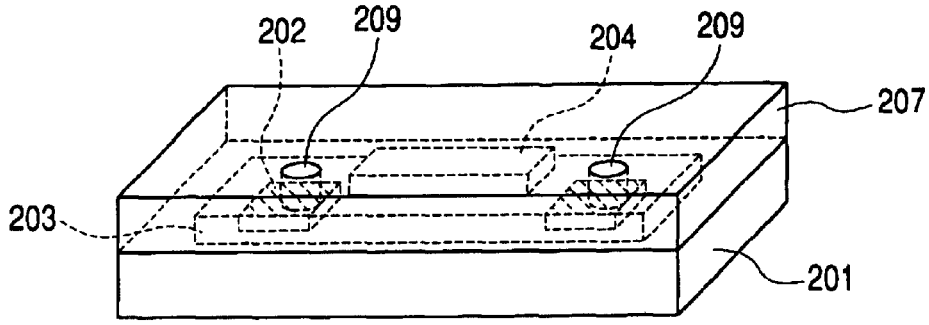
FIG. 16 is a schematic perspective view illustrating a process subsequent to the manufacturing state shown in FIG. 15.

Next, as shown in FIG. 16, a layer of a liquid channel structure material 207 is formed so as to cover the patterned lower layer of the thermal crosslinking positive resist layer 203 and the upper layer of the positive resist layer 204. The material of this liquid channel structure material layer 207 is produced by dissolving EHPE-3150 (50 pts.) marketed by Daicel Chemical Industries, Ltd., a cationic photopolymerization initiator SP-172 (1 pt.) marketed by Asahi Denka Co., Ltd., and a silane coupling agent A-187 (2.5 pts.) marketed by Nihonunica Corporation, into xylene (50 pts.) used as a coating solvent.

The coating of the liquid channel structure material 207 is conducted by spin coating, and the pre-baking is performed on a hot plate at 90° C. for 3 minutes.

Next, pattern exposure and developing are preformed to form ink discharge ports 209 in the liquid channel structure material 207 at which time any general-purpose exposure device may be applicable. Although not shown, a mask is used which prevents light irradiation onto a portion to be the ink discharge port upon the exposure. The Canon Mask Aligner MPA-600 Super is used for exposing, and an exposure amount is set to 500 mJ/cm$^2$. The developing is performed by immersing into xylene for 60 seconds, followed by baking at 100° C. for 1 hour, in order to enhance adherence of the liquid channel structure material.

Subsequently, although not shown, cyclized isoprene is coated on the liquid channel structure material layer in order to protect the material layer from alkaline solution. As a material of this cyclized isoprene, used is a material named as OBC marketed by Tokyo Ohka Kogyo Co., Ltd. Then, this silicone substrate is immersed into a tetramethylammonium hydroxide (TMAH) solution of 22 wt % at 83° C. for 14.5 hours to form a through hole for ink supply (not shown). Also, the silicon nitride used as a mask and membrane for forming ink supply holes is preliminarily patterned on the substrate. After such anisotropic etching, the silicon substrate is attached into a dry etching device so that its rear faces up, and a membrane film is removed by etchant prepared by mixing CF4 with oxygen of 5% density. Next, the silicon substrate is immersed into xylene to remove the OBC.

Figure 17:
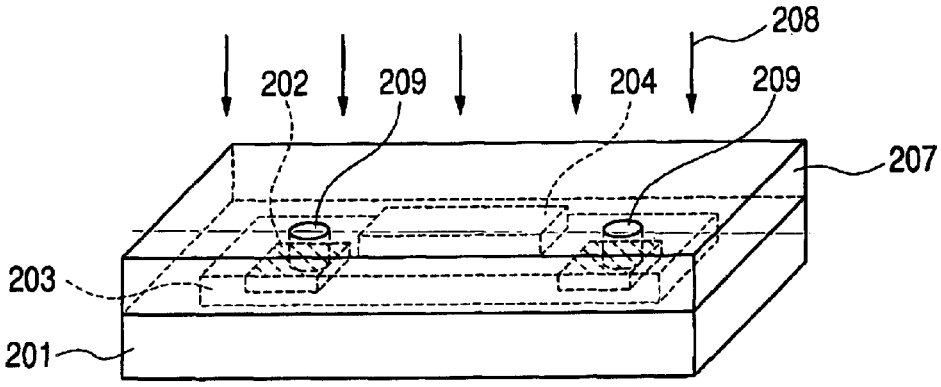
FIG. 17 is a schematic perspective view illustrating a process subsequent to the manufacturing state shown in FIG. 16.

Next, as shown in FIG. 17, the liquid channel structure material 207 is entirely irradiated with an ionizing radiation in a wavelength range from 210 nm to 330 nm using a low voltage mercury lamp to decompose the upper layer of the PMIPK positive resist and the lower layer of the thermal crosslinking positive resist. An irradiation amount is set to 81 J/cm$^2$.

Figure 18:
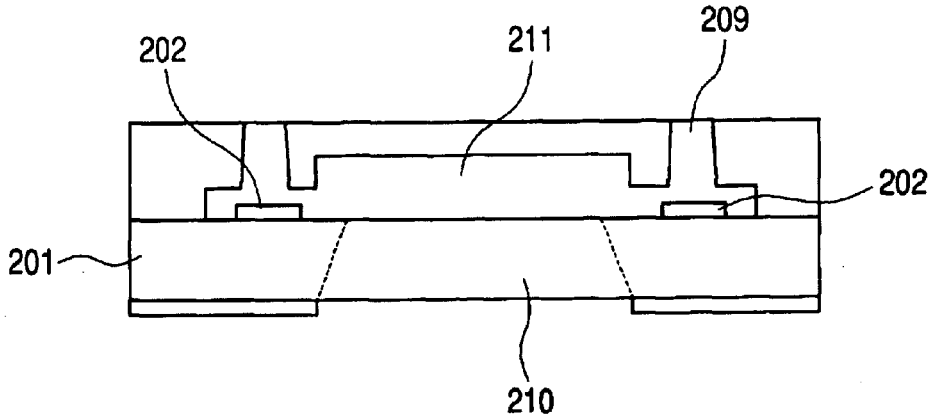
FIG. 18 is a schematic longitudinal sectional view illustrating a process subsequent to the manufacturing state shown in FIG. 17.

Subsequently, the substrate 201 is immersed in methyl lactate to remove a mold resist all together as shown by the longitudinal sectional view in FIG. 18. At this time, the substrate 201 is set in a mega sonic cell of 200 MHz for reduction of elution time. As a result, an ink channel 211 including discharge chambers is formed, and an ink discharge element is thus manufactured which has a structure in which the ink is guided from the ink supply ports 210 to each discharge chamber through each ink channel 211 and then is discharged from the discharge ports 209 by heaters.

Figure 19:
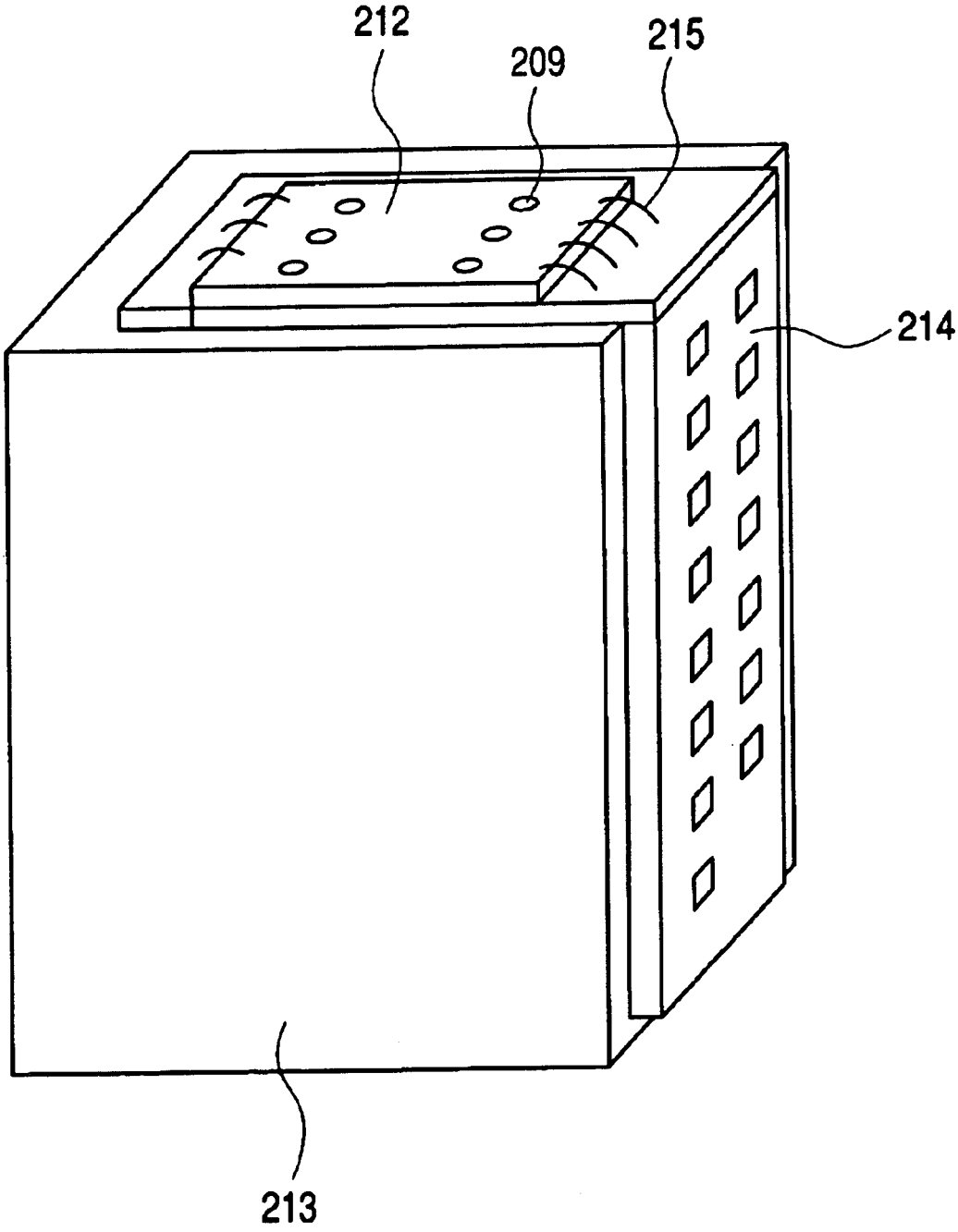
FIG. 19 is a schematic perspective view showing an ink-jet head unit implemented with an ink discharge element obtained by the manufacturing method shown in FIGS. 10 to 18.

The discharge element thus manufactured is implemented to an ink-jet head unit having a constitution shown in FIG. 19 whose discharge and recording evaluation provides excellent image recording status. The constitution of the ink-jet head unit is, as shown in FIG. 19, is so designed, for example, that a TAB film 214 for exchanging recording signals with a main body of a recording apparatus is provided on an outer face of a holding member detachably holding an ink tank 213 and that an ink discharge element 212 is connected to electric wirings via electrical connection leads 215 on the TAB film 214.

(Second Embodiment)

The ink-jet head with the structure shown in FIG. 6A that is manufactured according to the manufacturing method in the first embodiment will be described below.

Figure 20A:
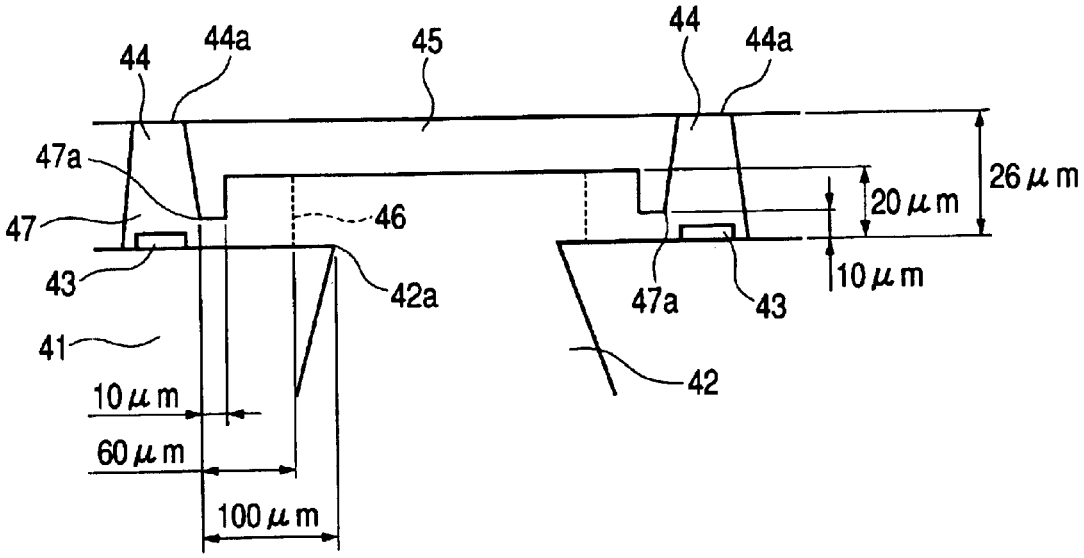
FIGS. 20A and 20B are diagrams showing structures of nozzles in heads manufactured to compare refilling capabilities between a conventional manufacturing method and the manufacturing method of the present invention.
Figure 20B:
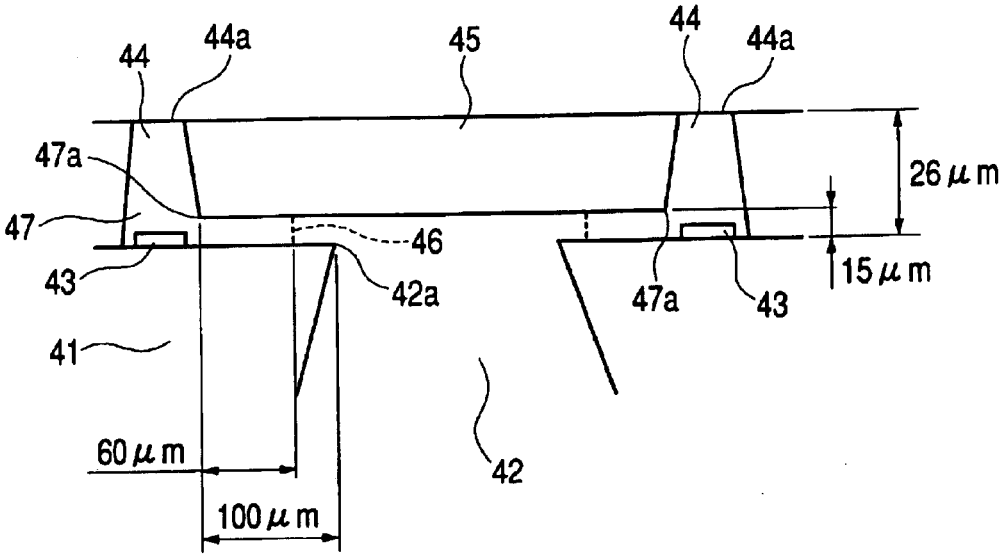

In this embodiment, as shown in FIGS. 20A and 20B, the ink-jet head is constituted so that a horizontal distance between an opening edge part 42*a* of the ink supply port 42 and an end part 47*a* of the discharge chamber 47 on the ink supply port side is 100 μm. An ink channel wall 46 is formed as far as a portion of 60 μm from the end part 47*a* of the discharge chamber 47 on the ink supply port side toward the ink supply port 42 side so as to divide each discharge element. Furthermore, a height of the ink channel is 10 μm in a region of 10 μm from the end part 47*a* of the discharge chamber 47 on the ink supply port 42 side toward the ink supply port 42 side, and in a region other than that, the height is 20 μm. A distance from the surface of the substrate 41 to that of the liquid channel structure material 45 is 26 μm.

FIG. 20B shows a cross section of an ink-jet head manufactured according to the conventional manufacturing method, wherein the ink head is constituted so as to have a 15 μm-high ink channel in its entire portion.

Measurement of refilling speed of ink after ink discharge by each head in FIGS. 20A and 20B provides results of 45 μsec. in the channel structure of FIG. 20A and 25 μsec. in the channel structure of FIG. 20B, which proves that the ink-jet head manufactured according to the method of the present invention provides extremely high speed of ink refilling.

(Third Embodiment)

The ink-jet head with the nozzle filters shown in FIG. 7A that is manufactured according to the manufacturing method in the first embodiment will be described below.

Referring to FIG. 7A, the nozzle filters 58 are formed into a columnar shape of 3 μm diameter at a position 20 μm apart from an opening edge part of the ink supply port 52 toward the discharge chamber 57 side. A distance between columns constituting both nozzle filters is 10 μm. The nozzle filters 59 shown in FIG. 7B are formed into the same shape in the same positions as those in this embodiment, but differ in that they reach the substrate 51.

Measurement of refilling speed of ink after ink discharge for each experimental head shown in FIGS. 7A and 7B provides results of 58 μsec. in the filter structure of FIG. 7A and 65 μsec. in the filter structure of FIG. 7B. This means that the ink-jet head having the constitution shown in FIG. 7A allows the reduction in refilling speed of ink.

(Fourth Embodiment)

The ink-jet head with the structure shown in FIG. 8A that is manufactured by way of experiment according to the manufacturing method in the first embodiment will be described below.

Referring to FIG. 8A, the ink channel corresponding to the ink supply port 62 is made higher as far as a portion of 30 μm from the opening edge part 62*b* of the ink supply port 62 toward a direction of the center of the ink supply port, and the thickness of the liquid channel structure material is 6 μm. A height of the ink channel corresponding to the ink supply port 62 which is other than the above portion is so designed that the thickness of the liquid channel structure material 65 may be 16 μm. The ink supply port 62 is 200 μm wide, and 14 mm long.

In a head shown in FIG. 8B, the thickness of a portion corresponding to the ink supply port 62 in the liquid channel structure material 65 is 6 μm.

A drop test from a height of 90 cm for each experimentally manufactured head in FIGS. 8A and 8B provides results that the nine out of ten heads having the structure in FIG. 8B develop cracks in the liquid channel structure material 65, on the other hand no cracks is found in all ten heads having the structure in FIG. 8A.

(Fifth Embodiment)

The ink-jet head with the structure shown in FIG. 9A that is manufactured by way of experiment according to the manufacturing method in the first embodiment will be described below.

Figure 21A:
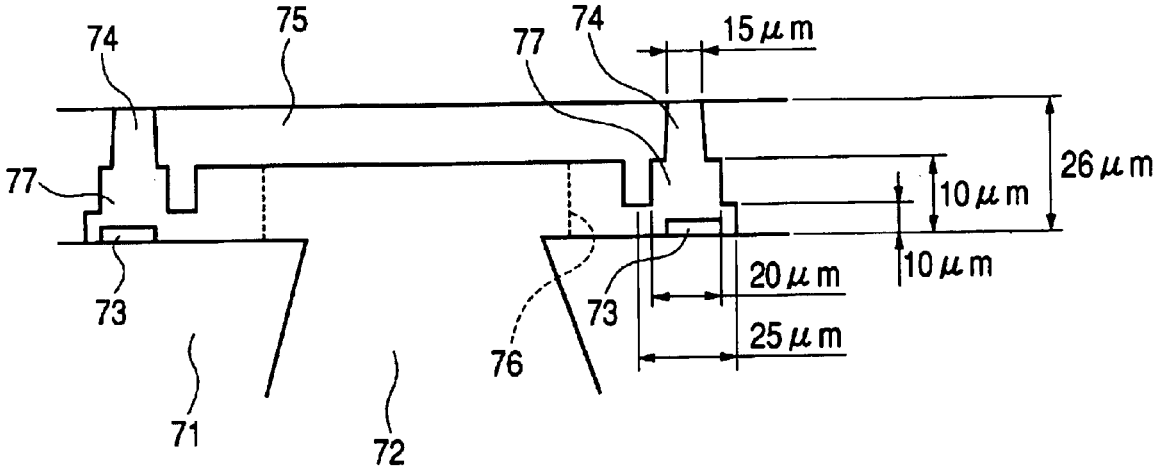
FIGS. 21A and 21B are diagrams showing structures of nozzles in heads manufactured to compare discharge properties between a conventional manufacturing method and the manufacturing method of the present invention.

In this embodiment, as shown in FIG. 21A, the discharge chamber 77 is so constituted as to have a rectangular part having a square of 25 μm side and a height of 10 μm which is formed by the lower layer resist, another rectangular part having a square of 20 μm side and a height of 10 μm which is formed by the upper layer resist, and a round hole of 15 μm diameter which is the discharge port. A distance from a heater 73 to an opening face of the discharge port 74 is 26 μm.

Figure 21B:
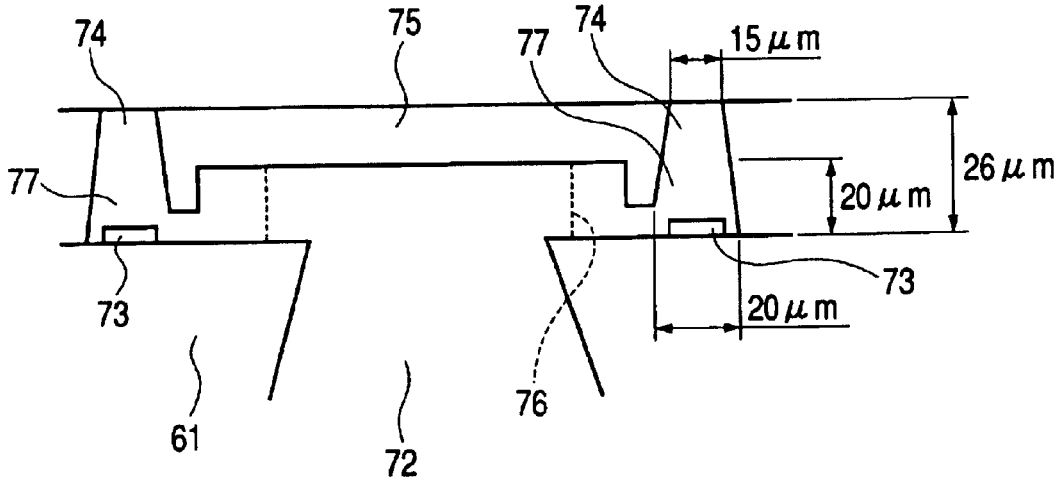

FIG. 21B shows a sectional shape of the discharge port of the head manufactured according to the manufacturing method of the present invention, where the discharge chamber has a rectangular shape having a square of 20 μm and a height of 20 μm. The discharge port 74 is formed into a round hole of 15 μm diameter.

Compared discharge properties of each head shown in FIGS. 21A and 21B with each other, the head shown in FIG. 21A provides, when a discharge amount is set to 3 ng, results of discharge speed of 15 m/sec. and hitting (dot placement) accuracy of 3 μm in a position 1 mm apart from the discharge port 74 in a discharge direction. The head shown in FIG. 21B provides, when a discharge amount is set to 3 ng as well, results of discharge speed of 9 m/sec. and hitting accuracy of 5 μm.

According to the present invention, the following advantages are provided.

1) The main process for manufacturing a liquid discharge head is based on a photolithography technique using a photoresist, photosensitive dry film, or the like, so that a minute portion of a liquid channel structure in the liquid discharge head may be extremely easily formed in a desired pattern, and a number of liquid discharge heads having the same structure may easily be machined simultaneously.

2) The height of a liquid channel may be varied partially, which enables to provide a liquid discharge head capable of immediately refilling ink and recording at high speed.

3) The thickness of a liquid channel structure material layer may be changed partially, which enables to provide a liquid discharge head with high mechanical strength.

4) A liquid discharge head that provides high discharge speed and high hitting accuracy may be manufactured, so that recording of high image quality is achieved.

5) A liquid discharge head with high density-multi array nozzles may be obtained by simple means.

6) The height of a liquid channel, and the length of an orifice part (discharge port portion) may easily and accurately be controlled by changing the coating thickness of a resist film.

7) By applying a thermal crosslinking positive resist, process conditions that provides extremely high process margin may be set and thus the liquid discharge head is manufactured in excellent yield.

What is claimed is:

1. A method of manufacturing a microstructure, comprising: a step of forming a thermally crosslinked first positive photosensitive material layer on a substrate, a step of forming on the first positive photosensitive material layer a second positive photosensitive material layer different from the first positive photosensitive material layer in a photosensitive wavelength range, a step of firstly forming a pattern on the second positive photosensitive material layer by decomposing and then developing only a desired area in the second positive photosensitive material layer, and a step of secondly forming a pattern different from that formed on the second positive photosensitive material layer on the first positive photosensitive material layer by decomposing and then developing a predetermined area in the first positive photosensitive material layer, wherein the first positive photosensitive material layer is an ionizing radiation decompositive positive resist composed of a methacrylic copolymer composite mainly containing a methacrylate and also containing methacrylic acid as a thermal crosslinking factor, where a methacrylic acid unit is 2 to 30 wt % and copolymer molecular weight is 5,000 to 50,000, and the second positive photosensitive material layer is an ionizing radiation decompositive positive resist which mainly contains polymethyl isopropenyl ketone.

2. The method of manufacturing the microstructure according to claim 1, wherein the methacrylic copolymer composite is formed by radical polymerization.

3. The method of manufacturing the microstructure according to claim 2, wherein the first positive photosensitive material layer is thermally crosslinked by dehydration reaction.

4. A method of manufacturing a liquid discharge head comprising: a step of forming a mold pattern by a removable resin in a liquid channel forming portion on a substrate on which is formed a liquid discharge energy generating element, and a step of coating and then curing a coating resin layer on the substrate so as to coat the mold pattern to form a liquid channel by dissolving away the mold pattern, wherein the step of forming the mold pattern successively comprises:

a step of forming on the substrate a first positive photosensitive material layer thermally crosslinked by means of a thermal crosslinking reaction;

a step of forming on the first positive photosensitive material layer a second positive photosensitive material layer different from the first positive photosensitive in a photosensitive wavelength range;

a step of forming a desired pattern on the second positive photosensitive material layer by decomposing and then developing only a desired pattern on the second positive photosensitive material layer by means of an ionizing radiation for exposing the second positive photosensitive material layer onto the substrate on which two layers of the positive photosensitive material layers are formed; and a step of forming another desired pattern on the first positive photosensitive material layer by decomposing and then developing a predetermined area on the first positive photosensitive material layer by means of an ionizing radiation for exposing the first positive photosensitive material layer onto the substrate on which the desired pattern is formed on the second positive photosensitive material layer, and the first positive photosensitive material layer is an ionizing radiation decompositive positive resist composed of a methacrylic copolymer composite mainly containing a methacrylate and also containing methacrylic acid as a thermal crosslinking factor, where a methacrylic acid unit is 2 to 30 wt % and copolymer molecular weight is 5,000 to 50,000, and the second positive photosensitive material layer is an ionizing radiation decompositive positive resist which mainly contains polymethyl isopropenyl ketone.

5. The method of manufacturing the liquid discharge head according to claim 4, further comprising:

a step of coating a negative photosensitive coating resin film on the patterned first positive photosensitive material layer and second positive photosensitive material layer;

a step of forming a discharge port portion by exposing and then developing a pattern including a discharge port communicated with the liquid channel of the negative photosensitive coating resin film;

a step of decomposing the first positive photosensitive material layer and the second positive photosensitive material layer by irradiating an ionization radiation onto the first and second positive photosensitive material layers at a wavelength range in which decomposition reaction occurs in the both first and second positive photosensitive material layers; and a step of forming the liquid channel by immersing the substrate into an organic solvent to dissolve away the first and second positive photosensitive material layers.

6. A liquid discharge head obtained by the method of manufacturing according to claim 4.

7. The liquid discharge head according to claim 6, wherein a columnar member for trapping dust is formed of a material composing the liquid channel in the middle of the liquid channel.

8. The liquid discharge head according to claim 7, wherein the columnar member for trapping dust which is formed in the liquid channel does not reach the substrate.

9. The liquid discharge head according to claim 7, wherein a liquid supply port commonly connected to each of the liquid channels are formed in the substrate, and a height of the liquid channel in a center portion of the liquid supply port is lower than that of the liquid channel in an opening edge portion of the liquid supply port.

10. The liquid discharge head according to claim 7, wherein a sectional shape of a bubble generating chamber provided above a liquid discharge energy generating element has a protruded form.

11. An ink-jet head including therein the liquid discharge head according to claim 7.

12. An ink-jet head including therein the liquid discharge head according to claim 8.

13. An ink-jet head including therein the liquid discharge head according to claim 9.

14. An ink-jet head including therein the liquid discharge head according to claim 10.

* * * * *